US010907445B2

(12) United States Patent
Huggins et al.

(10) Patent No.: US 10,907,445 B2
(45) Date of Patent: Feb. 2, 2021

(54) AUTOFILL AND CIRCULATION ASSEMBLY AND METHOD OF USING THE SAME

(71) Applicant: Halliburton Energy Services, Inc., Houston, TX (US)

(72) Inventors: Jeffrey Wythe Huggins, Grapevine, TX (US); Adam Evan Beck, Flower Mound, TX (US); Joseph Steven Grieco, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 404 days.

(21) Appl. No.: 14/766,349

(22) PCT Filed: Feb. 25, 2013

(86) PCT No.: PCT/US2013/027674
§ 371 (c)(1),
(2) Date: Aug. 6, 2015

(87) PCT Pub. No.: WO2014/130053
PCT Pub. Date: Aug. 28, 2014

(65) Prior Publication Data

US 2015/0376985 A1 Dec. 31, 2015

(51) Int. Cl.
*E21B 34/12* (2006.01)
*E21B 21/10* (2006.01)

(52) U.S. Cl.
CPC ..... *E21B 34/12* (2013.01); *E21B 21/103* (2013.01); *E21B 2200/06* (2020.05)

(58) Field of Classification Search
CPC ... E21B 34/12; E21B 21/103; E21B 2034/007
See application file for complete search history.

(56) References Cited

U.S. PATENT DOCUMENTS 4,407,362 A * 10/1983 Bechthold ..... E21B 23/03 166/117.5
4,766,960 A * 8/1988 Williamson, Jr. ..... E21B 34/06 166/321

(Continued)

FOREIGN PATENT DOCUMENTS

EP 0939193 A2 * 9/1999 ..... E21B 21/103
EP 0939193 A2 9/1999
WO 2011072367 A1 6/2011

OTHER PUBLICATIONS

International Preliminary Report on Patentability issued in related PCT Application No. PCT/US2013/027674, dated Sep. 3, 2015 (9 pages).

(Continued)

*Primary Examiner* — Waseem Moorad
*Assistant Examiner* — Neel Girish Patel
(74) *Attorney, Agent, or Firm* — Scott Richardson; Baker Botts L.L.P.

(57) ABSTRACT

A wellbore system comprising an autofill and circulation assembly comprising a housing defining a flowbore and comprising a first port and a second port, and a first sleeve slidable within the housing from a first position to a second position and from the second position to a third position, when the first sleeve is in the first position, the assembly allows fluid communication from an exterior of the housing to the flowbore via the first port and does not allow fluid communication from the flowbore to the exterior of the housing via the first port, when the first sleeve is in the second position, the assembly allows bidirectional fluid communication between the exterior of the housing and the flowbore via the second port, and, when the first sleeve is in the third position, the assembly disallows fluid communication between the exterior of the housing and the flowbore.

19 Claims, 6 Drawing Sheets

(56) References Cited

U.S. PATENT DOCUMENTS 5,048,611 A * 9/1991 Cochran ..... E21B 21/103 166/374
5,176,220 A * 1/1993 Akkerman ..... E21B 34/08 166/321
6,059,038 A * 5/2000 Vick, Jr. ..... E21B 21/103 166/319
6,152,224 A * 11/2000 French ..... E21B 33/127 166/250.08
6,364,017 B1 4/2002 Stout et al.
7,967,071 B2 6/2011 Brown
8,291,982 B2 10/2012 Murray et al.
9,546,537 B2 * 1/2017 Greci ..... E21B 43/08
2002/0070023 A1 6/2002 Turner et al.
2005/0224231 A1 10/2005 Surjaatmadja
2009/0044944 A1 * 2/2009 Murray ..... E21B 43/02 166/308.1
2009/0056952 A1 * 3/2009 Churchill ..... E21B 34/14 166/373
2009/0065194 A1 * 3/2009 Frazier ..... E21B 33/14 166/168
2009/0211748 A1 * 8/2009 Revheim ..... E21B 33/14 166/66.5
2010/0224371 A1 * 9/2010 Swan ..... E21B 21/103 166/373
2010/0243254 A1 * 9/2010 Murphy ..... E21B 23/01 166/305.1
2010/0252281 A1 * 10/2010 Telfer ..... E21B 21/103 166/386
2011/0036590 A1 * 2/2011 Williamson ..... E21B 43/25 166/373
2011/0284232 A1 * 11/2011 Huang ..... E21B 21/103 166/317
2012/0118579 A1 * 5/2012 Murray ..... E21B 23/006 166/332.1
2013/0068472 A1 * 3/2013 Lauderdale ..... E21B 34/14 166/373
2013/0248193 A1 * 9/2013 Brekke ..... E21B 34/063 166/317
2015/0083428 A1 * 3/2015 Vick, Jr. ..... E21B 21/103 166/318

OTHER PUBLICATIONS

Search Report issued in related European Application No. 13875623.4 dated Feb. 7, 2017 (7 pages).
International Search Report and Written Opinion issued in related PCT Application No. PCT/US2013/027674 dated Nov. 11, 2013, 13 pages.

* cited by examiner

AUTOFILL AND CIRCULATION ASSEMBLY AND METHOD OF USING THE SAME

CROSS-REFERENCE TO RELATED APPLICATION

The present application is a U.S. National Stage Application of International Application No. PCT/US2013/027674 filed Feb. 25, 2013, which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon wells (for example, for the production of hydrocarbons such as oil and gas) typically have a wellbore drilled into a subterranean formation (e.g., in the ground) containing the hydrocarbons. Such formations typically have one or more production zones that may be accessed to extract the formation fluids (for example, hydrocarbons) via the wellbore. In some embodiments, a production zone may be completed as an open-hole (e.g., an "uncased") completion. Alternatively, a production zone can be completed, for example, by placing a casing within a portion of the wellbore and perforating (or otherwise providing a route of fluid communication into) the casing, for example, in a position adjacent to a production zone. Often two or more production zones may be separated or isolated from each other using isolation devices (e.g., hydraulic, swellable, and/or mechanical packers) inserted into the wellbore.

In an embodiment, during "run-in" of a production string (e.g., placement of a production string or other tubular string within a wellbore, it may be desirable to allow fluid and/or pressure to enter the production string (or other tubular string) from the exterior of the production string and to prevent fluid and/or pressure from exiting the production string. Additionally, following placement of the production string, it may be desirable to selectively alter the various flowpaths in to or out of the production string. Thus, a need exists to selectively control fluid communication between the interior and exterior of the production string.

SUMMARY

Disclosed herein is a wellbore completion system comprising a tubular string disposed within a wellbore, an autofill and circulation assembly (ACA) incorporated within the tubular string and comprising a housing generally defining an axial flowbore and comprising a first flow port and a second flow port extending between the axial flowbore and an exterior of the housing, and a first sleeve slidably positioned within the housing and transitional from a first longitudinal position to a second longitudinal position and from the second longitudinal position to a third longitudinal position, wherein, when the first sleeve is in the first position, the ACA is configured to allow a route of fluid communication from the exterior of the housing to the axial flowbore via the first flow port and to not allow a route of fluid communication from the axial flowbore to the exterior of the housing via the first flow port, wherein, when the first sleeve is in the second position, the ACA is configured to allow a bidirectional route of fluid communication between the exterior of the housing and the axial flowbore via the second flow port, and wherein, when the first sleeve is in the third position, the ACA is configured to disallow a route of fluid communication between the exterior of the housing and the axial flowbore.

Also disclosed herein is a wellbore completion method comprising positioning a tubular string comprising an autofill and circulation assembly (ACA) within a wellbore, wherein the ACA is positioned within the wellbore in a first configuration, wherein, when the ACA is in the first configuration, the ACA allows a route of fluid communication from an exterior of the ACA to an axial flowbore of the ACA and to not allow a route of fluid communication from the axial flowbore to the exterior of the housing, causing the ACA to experience a first pressure differential in which the pressure applied to the axial flowbore is greater than the pressure applied to the exterior of the housing by at least a first threshold pressure so as to transition the ACA from the first configuration to a second configuration, communicating a fluid from the axial flowbore to the exterior of the housing, communicating a fluid from the exterior of the housing to the axial flowbore, or combinations thereof, and transitioning the ACA from the second configuration to a third configuration, wherein, when the ACA is in the third configuration, the ACA disallows a route of fluid communication between the exterior of the ACA and the axial flowbore the ACA.

Further disclosed herein is a wellbore completion tool comprising generally defining an axial flowbore, wherein the wellbore completion tool is selectively transitioned from a first configuration to a second configuration and from the second configuration to a third configuration, wherein, when the wellbore completion tool is in the first configuration, the wellbore completion tool allows fluid communication from an exterior of the tool to the axial flowbore and to not allow fluid communication from the axial flowbore to the exterior of the tool, wherein, when the wellbore completion tool is in the second configuration, the wellbore completion tool allows fluid communication from the axial flowbore to the exterior of the tool, wherein, when the wellbore completion tool is in the third configuration, the wellbore completion tool does not allow fluid communication between the axial flowbore and the exterior of the tool, wherein, the wellbore completion tool selectively transitions from the first configuration to the second configuration upon experiencing a first pressure differential in which the pressure applied to the axial flowbore is greater than the pressure applied to the exterior of the tool by at least a first threshold pressure, upon a pressure of at least a first threshold pressure being applied to the axial flowbore, or combinations thereof, and wherein, the wellbore completion tool selectively transitions from the second configuration to the third configuration upon experiencing a pressure of at least a second threshold pressure applied to the exterior of the tool, upon a fluid being communicated through the axial flowbore at a predetermined rate, or combinations thereof.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
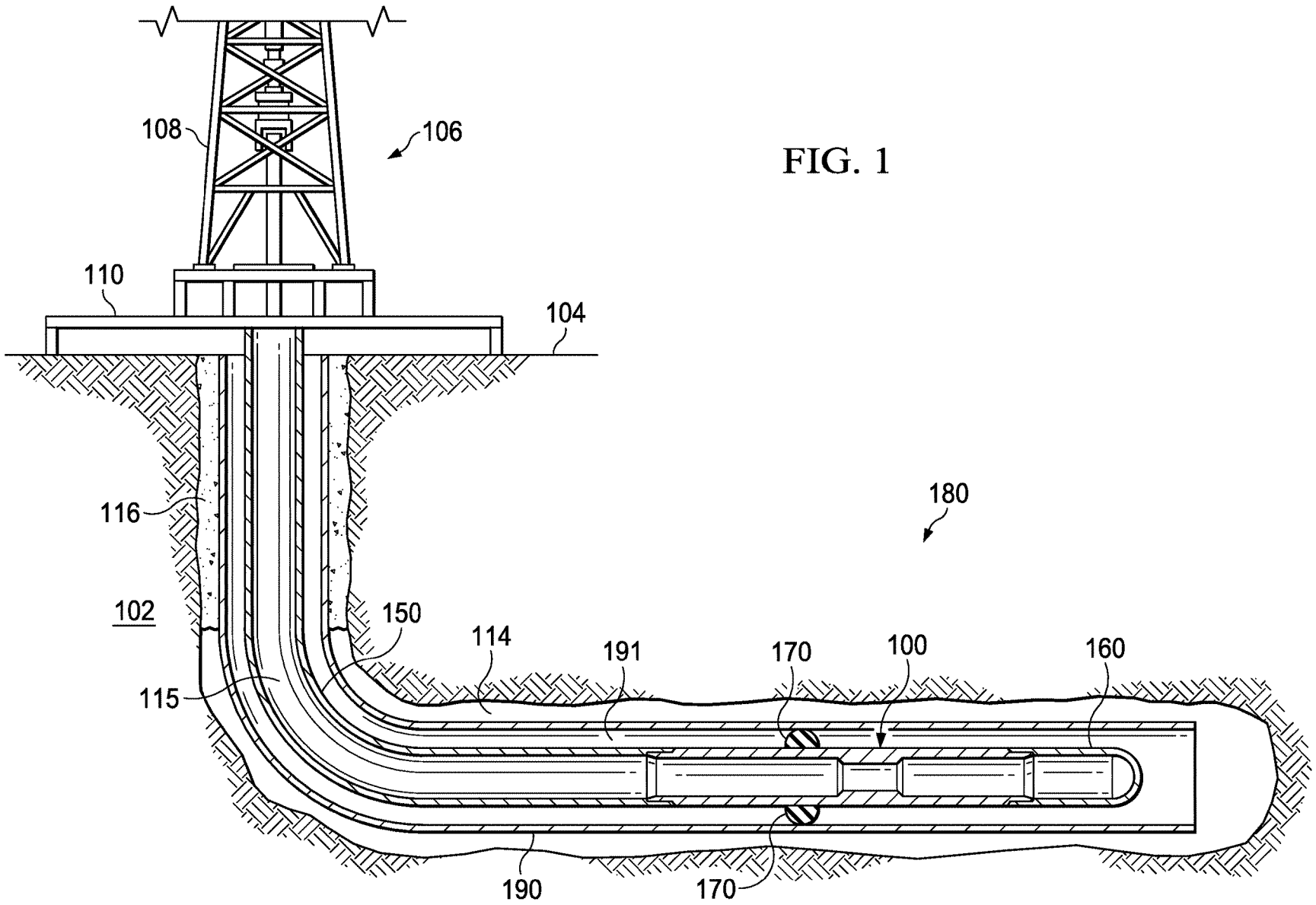
FIG. 1 is a partial cut-away view of an operating environment of a autofill and circulation assembly depicting a wellbore penetrating a subterranean formation and a production string having autofill and circulation assembly incorporated therein and positioned within the wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of an autofill and circulation assembly (ACA) and methods of using the same. Particularly, disclosed herein are one or more embodiments of an ACA which may be incorporated within a wellbore tubular, for example a production string and/or production tubular positioned within a wellbore penetrating a subterranean formation.

In an embodiment, a production string comprising an ACA may be configured such that during "run-in" (e.g., into a wellbore) fluid is allowed to be communicated from the exterior of the production string to the flowbore of the production string. Where a production string has been placed within a wellbore and, for example, prior to the commencement of stimulation (e.g., fracturing and/or perforating) operations, it may be desirable to circulate a fluid from the interior of the production string and/or the ACA, for example, to replace and/or remove a fluid contained within the production string and/or ACA during "run-in." In an embodiment, an ACA may be configured such that fluid may be circulated via a route of fluid communication from a flowbore of the ACA to the exterior of the ACA. Additionally, following circulation, it may be desirable to disallow fluid communication between the exterior of the production string and the flowbore of the production string. In an embodiment, the ACA may be configured so as to disallow fluid communication between the exterior of the production of the flowbore of the production string.

Although an ACA is disclosed with reference to use or incorporation with a production string, an ACA or similarly configured tool may be used or incorporated within other suitable tubulars such as a casing string, a work string, liner, coiled tubing, a length of tubing, or the like.

Referring to FIG. 1, an embodiment of an operating environment in which such a ACA may be employed is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1, the operating environment comprises a drilling or servicing rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 by any suitable drilling technique. In an embodiment, the drilling or servicing rig 106 comprises a derrick 108 with a rig floor 110 through which a completion string 190 (e.g., a casing string) generally defining an axial flowbore 191 may be positioned within the wellbore 114. The drilling or servicing rig 106 may be conventional and may comprise a motor driven winch and other associated equipment for lowering a tubular, such as the completion string 190 into the wellbore 114, for example, so as to position the completion equipment at the desired depth.

In an embodiment the wellbore 114 may extend substantially vertically away from the earth's surface 104 over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In an embodiment, a portion of the completion string 190 may be secured into position against the formation 102 in a conventional manner using cement 116. In alternative embodiment, the wellbore 114 may be partially completed (e.g., cased) and cemented thereby resulting in a portion of the wellbore 114 being uncemented. In an embodiment, a production string 150 comprising an ACA 100 may be delivered to a predetermined depth within the wellbore.

It is noted that although the ACA 100 is disclosed as being incorporated within a production string in one or more embodiments, the specification should not be construed as so-limiting. A tool such as the ACA 100 may similarly be incorporated within other suitable tubulars such as a casing string, a work string, liner, coiled tubing, a length of tubing, or the like.

Referring to FIG. 1, the production string 150 and/or the ACA 100 may further comprise (e.g., have incorporated therein) one or more packers 170, for example, for the purpose of securing the production string 150 and/or the ACA 100 within the wellbore 114, within the completion string 190, and/or isolating two or more production zones. The packer 170 may generally comprise a device or apparatus which is selectively configurable to seal or isolate two or more depths in a wellbore from each other by providing a barrier concentrically about a tubular string (e.g., the production string 150) and an outer surface (e.g., a wellbore or casing wall). In an embodiment, the packer 170 may comprise a hydraulic (or hydraulically set) packer. Alternatively, the packer may comprise any suitable configuration of mechanical packer or a swellable packer (for example, SwellPackers™, commercially available from Halliburton Energy Services).

Additionally, in an embodiment, a portion of the interior of the production string 150 may be blocked with a plug 160, for example, so as to allow a pressure to be applied thereto. For example, in an embodiment of FIG. 1, the plug 160 may be positioned down-hole from the ACA 100, thereby prohibiting and/or substantially restricting a fluid from moving via the axial flowbore of the production string 150, particularly, from moving out of the downhole, terminal end of the production string 150. Non-limiting examples of a plug suitably employed as plug 160 include a pump-through plug or a plug formed as an integral part of a production string (for example, The Mirage™ disappearing plug, commercially available from Halliburton Energy Services).

While the operating environment depicted in FIG. 1 refers to a stationary drilling or servicing rig 106 for lowering and setting the production string 150 within a land-based wellbore 114, one of ordinary skill in the art will readily appreciate that mobile workover rigs, wellbore completion units (e.g., coiled tubing units). It should be understood that an ACA may be employed within other operational environments, such as within an offshore wellbore operational environment.

Referring to FIG. 1, a wellbore completion system 180 is illustrated. In the embodiment of FIG. 1, the wellbore completion system 180 comprises an ACA 100 incorporated with the production string 150 and positioned within a wellbore 114. Additionally, in an embodiment, the wellbore completion system 180 may further comprise the plug 160. In such an embodiment, the plug 160 may be incorporated with the production string 150, for example, as an integral part of the production string 150 and may be positioned relatively down-hole from the ACA 100.

In one or more of the embodiments as will be disclosed herein, the ACA 100 may be configured to transition from a first configuration to a second configuration and from the second configuration to a third configuration while disposed the wellbore 114. Particularly, a first embodiment is disclosed with respect to FIGS. 2A-2C, a second embodiment is disclosed with respect to FIGS. 3A-3C, and a third embodiment is disclosed with respect to FIGS. 4A-4C.

Figure 2A:
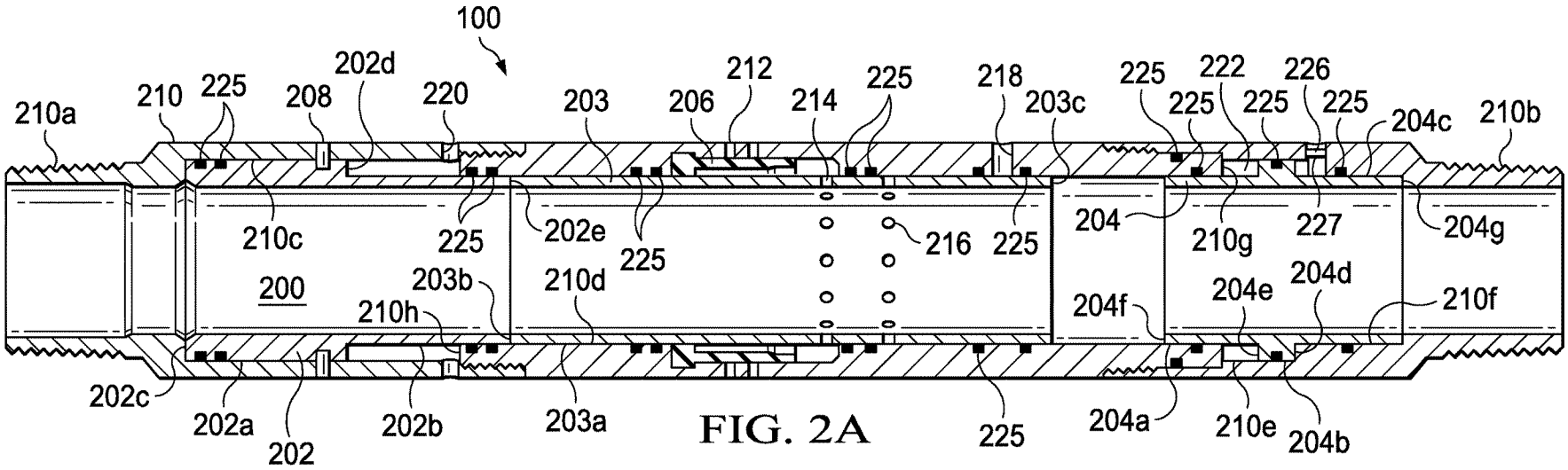
FIG. 2A is partial cut-away view of a first embodiment of an autofill and circulation assembly in a first configuration.
Figure 2B:
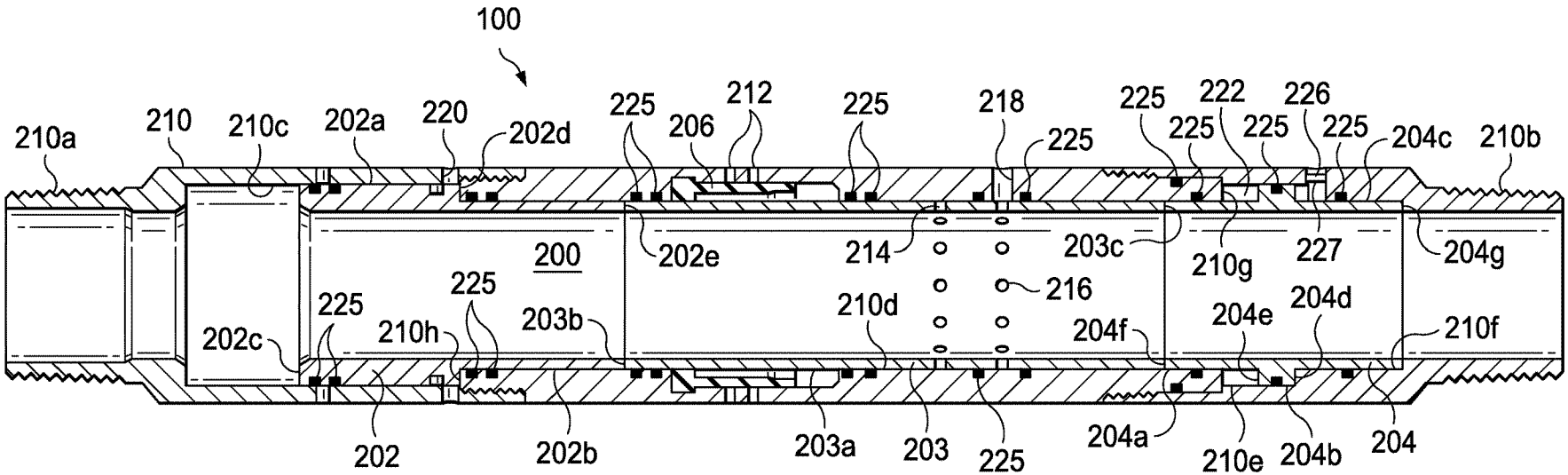
FIG. 2B is partial cut-away view of the first embodiment of an autofill and circulation assembly in a second configuration.
Figure 2C:
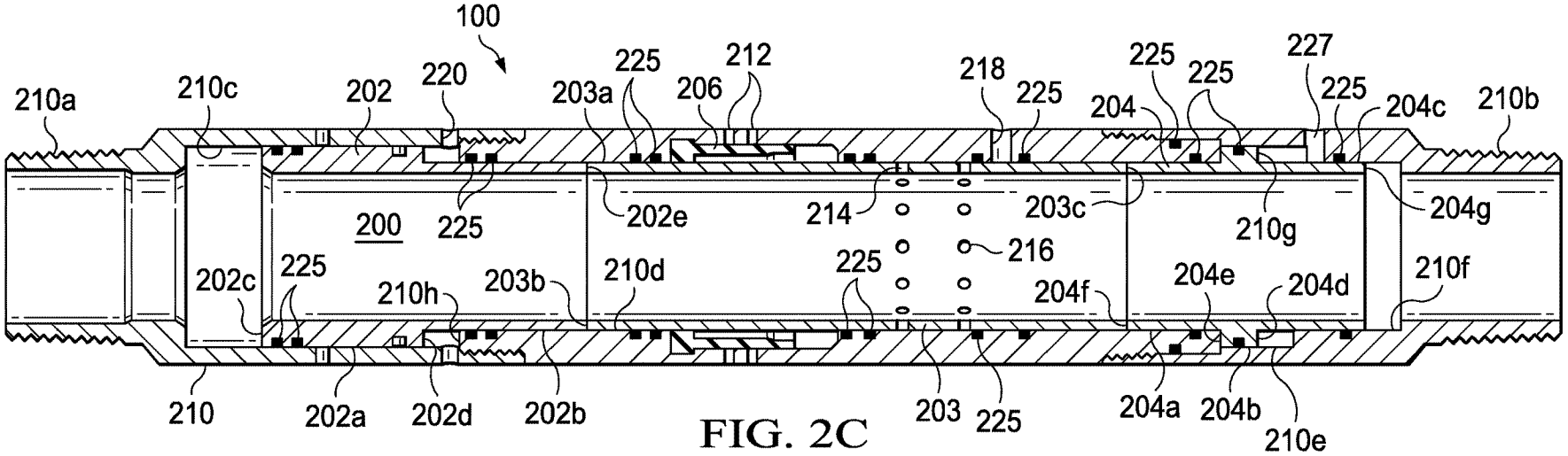
FIG. 2C is partial cut-away view of the embodiment of an autofill and circulation assembly in a third configuration.
Figure 3A:
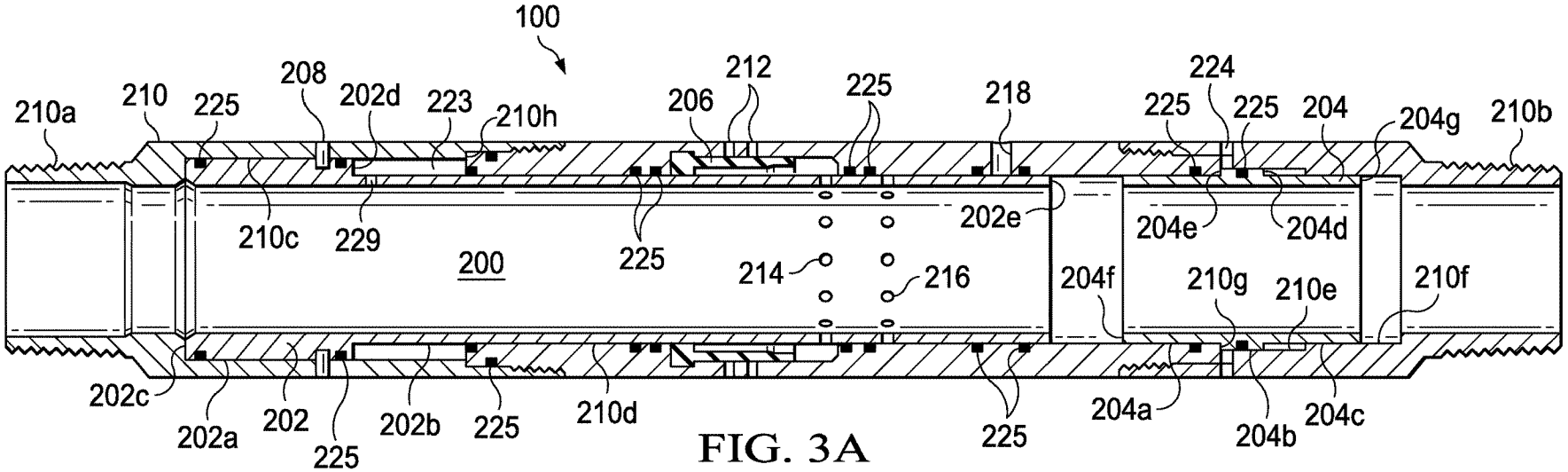
FIG. 3A is partial cut-away view of a second embodiment of an autofill and circulation assembly in a first configuration.
Figure 3B:
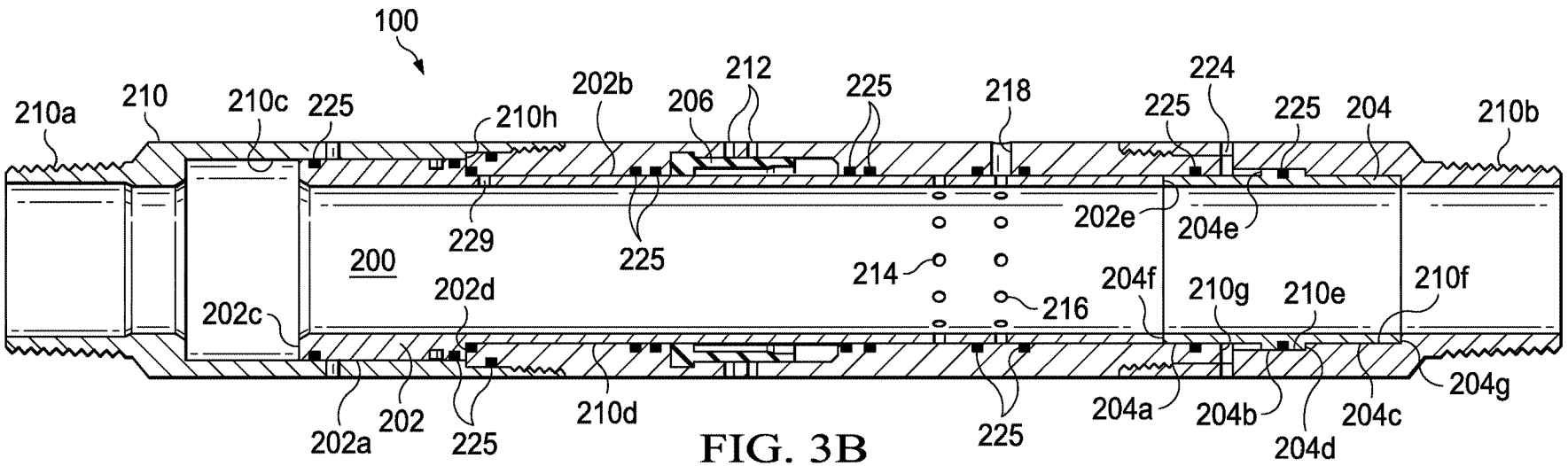
FIG. 3B is partial cut-away view of the second embodiment of an autofill and circulation assembly in a second configuration.
Figure 3C:
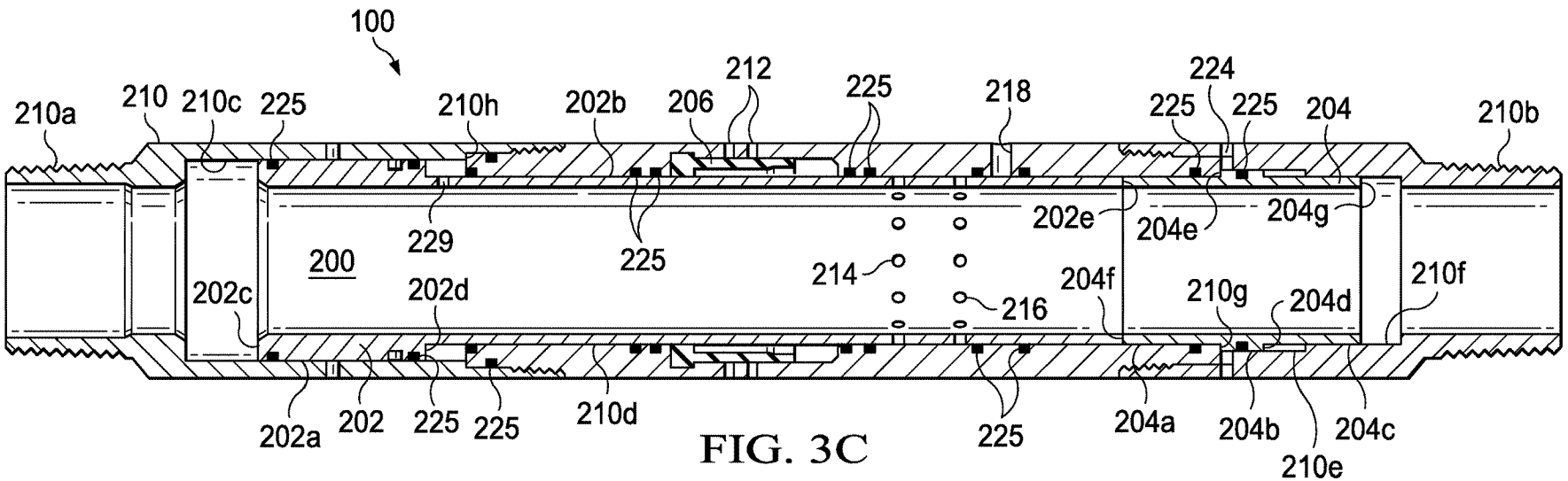
FIG. 3C is partial cut-away view of the second embodiment of an autofill and circulation assembly in a third configuration.
Figure 4A:
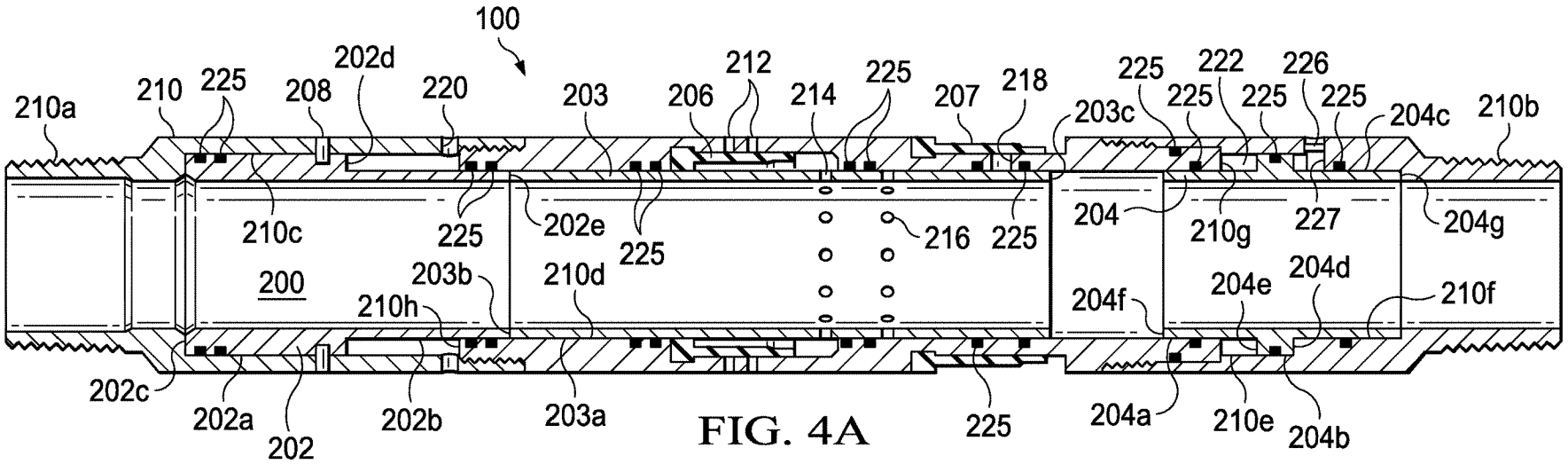
FIG. 4A is partial cut-away view of a third embodiment of an autofill and circulation assembly in a first configuration.

Referring to FIGS. 2A, 3A, and 4A, the ACA 100 is illustrated in the first configuration. In an embodiment, when the ACA 100 is in the first configuration, also referred to as a run-in configuration or installation configuration, the ACA 100 may be configured so as to allow a route of fluid and/or pressure communication in a first direction, particularly, from the exterior of the ACA 100 (e.g., from the wellbore 114) to an axial flowbore 200 of the ACA 100 and not in a second direction from the axial flowbore 200 of the ACA 100 to the exterior of the ACA 100. In an embodiment (e.g., in the embodiments of FIGS. 2A-2C and 4A-4C, as will be disclosed herein), the ACA 100 may be configured to transition from the first configuration to the second configuration upon the application of a fluid pressure to the axial flowbore 200 of the ACA 100, for example, thereby causing a pressure differential of at least a first threshold pressure between the pressure applied within the axial flowbore 200 of the ACA 100 and the exterior of the ACA 100, as will be disclosed herein. In an alternative embodiment (e.g., in the embodiment of FIG. 3A-3C), the ACA 100 may be configured to transition from the first configuration to the second configuration upon the application of a fluid pressure of at least a first threshold pressure to the axial flowbore 200. In such embodiments, the first threshold pressure (e.g., the differential) may be at least about 500 psi, alternatively, about 750 psi, alternatively, about 1,000 psi, alternatively, about 1,500 psi, alternatively, about 2,000 psi, alternatively, about 2,500 psi, alternatively, about 3,000 psi, alternatively, about 4,000 psi, alternatively, about 5,000 psi, alternatively, about 6,000 psi, alternatively, about 7,000 psi, alternatively, about 8,000 psi, alternatively, about 10,000 psi, alternatively, alternatively, about 12,000 psi, alternatively, about 14,000 psi, alternatively, about 16,000 psi, alternatively, about 18,000 psi, alternatively, about 20,000 psi, alternatively, any suitable pressure. As will be appreciated by one of skill in the art upon viewing this disclosure, the first threshold pressure may depend upon various factors, for example, including, but not limited to, the type of wellbore servicing operation being implemented.

Figure 4B:
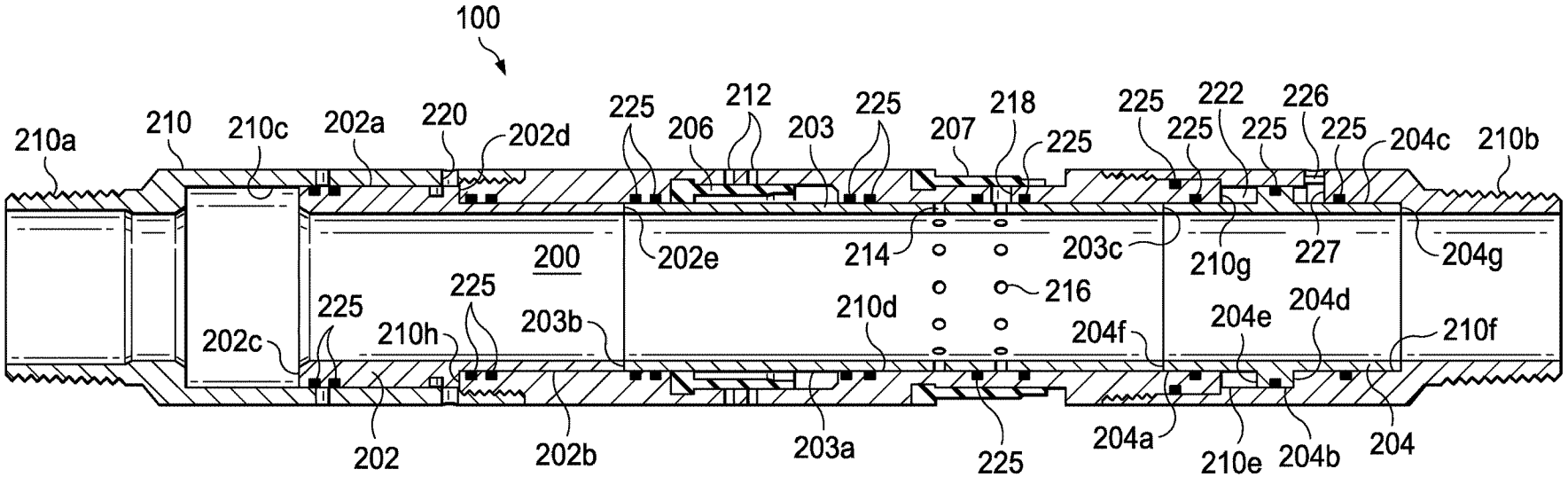
FIG. 4B is partial cut-away view of the third embodiment of an autofill and circulation assembly in a second configuration.

Referring to FIGS. 2B, 3B and 4B, the ACA 100 is illustrated in the second configuration. In the embodiments of FIGS. 2B and 3B, when the ACA 100 is in the second configuration, the ACA 100 may be configured so as to allow bidirectional fluid and/or pressure communication between the exterior of the ACA 100 and the axial flowbore 200 of the ACA 100. In the embodiment of FIG. 4B, the ACA 100 may be configured so as to allow a route of fluid and/or pressure communication in the second direction, particularly, from the axial flowbore 200 of the ACA 100 to exterior of the ACA 100 and not in the first direction (e.g., from the exterior of the ACA 100 to the axial flowbore 200 of the ACA 100). In an embodiment (e.g., in the embodiments of FIGS. 2A-2C and 4A-4C, as will be disclosed herein), the ACA 100 may be configured to transition from the second configuration to the third configuration upon the application of a pressure of at least a second threshold to the exterior of the ACA 100 (and/or a decrease in the pressure applied to the axial flowbore 200), for example, which may or may not result in a pressure differential pressure between the pressure applied to the exterior of the ACA 100 and the pressure of the axial flowbore 200 of the ACA 100, as will be disclosed herein. In another embodiment (e.g., in the embodiment of FIG. 3A-3C, as will be disclosed herein), the ACA 100 may be configured to transition from the second configuration to the third configuration upon experiencing a pressure differential between the pressure applied to the exterior of the ACA 100 and the axial flowbore 200 of the ACA 100, for example, as may result from an increased flow rate of fluid via the axial flowbore 200, as will be disclosed herein. In such embodiments, the second threshold pressure may be at least about 500 psi, alternatively, about 750 psi, alternatively, about 1,000 psi, alternatively, about 1,500 psi, alternatively, about 2,000 psi, alternatively, about 2,500 psi, alternatively, about 3,000 psi, alternatively, about 4,000 psi, alternatively, about 5,000 psi, alternatively, about 6,000 psi, alternatively, about 7,000 psi, alternatively, about 8,000 psi, alternatively, about 10,000 psi, alternatively, alternatively, about 12,000 psi, alternatively, about 14,000 psi, alternatively, about 16,000 psi, alternatively, about 18,000 psi, alternatively, about 20,000 psi, alternatively, any suitable pressure. As will be appreciated by one of skill in the art upon viewing this disclosure, the second threshold pressure may depend upon various factors, for example, including, but not limited to, the type of wellbore servicing operation being implemented.

Figure 4C:
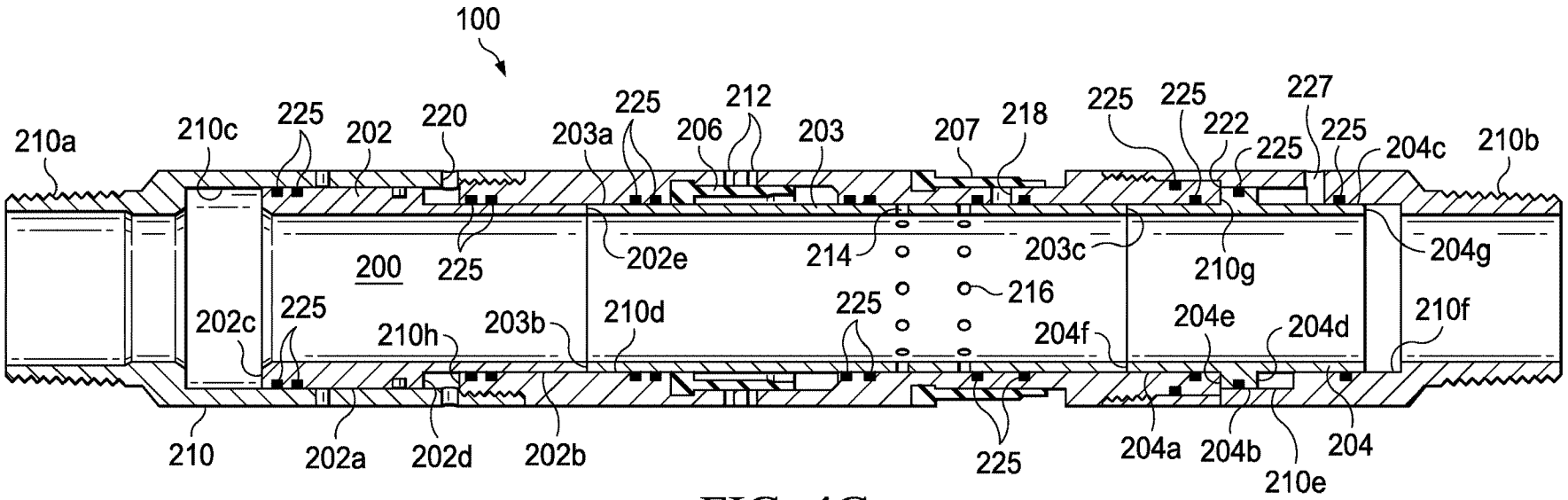
FIG. 4C is partial cut-away view of the third embodiment of an autofill and circulation assembly in a third configuration.

Referring to FIGS. 2C, 3C, and 4C, the ACA 100 is illustrated in the third configuration. In the embodiments of FIGS. 2C, 3C, and 4C, when the ACA 100 is in the third configuration, the ACA 100 may be configured so as disallow fluid communication between the axial flowbore 200 of the ACA 100 and the exterior of the ACA 100.

In an embodiment (e.g., in the embodiment of FIGS. 2A-2C and 4A-4C), the ACA 100 generally comprises a housing 210, an upper sleeve 202, an intermediate sleeve 203, a lower sleeve 204, and a valve 206. In another embodiment (e.g., in the embodiment of FIGS. 3A-3C), the ACA 100 generally comprises a housing 210, an upper sleeve 202, a lower sleeve 204, and a valve 206. While various embodiments of the ACA 100 are illustrated and disclosed with respect to FIGS. 2A-2C, 3A-3C, and 4A-4C, one of ordinary skill in the art upon viewing this disclosure, will recognize suitable alternative configurations. As such, while embodiments of an ACA may be disclosed with reference to a given configuration (e.g., as will be disclosed with respect to FIGS. 2A-2C, 3A-3C, and 4A-4C), this disclosure should not be construed as limited to such embodiments.

In an embodiment, the housing 210 may be characterized as a generally tubular body having a first terminal end 210*a* (e.g., an up-hole end) and a second terminal end 210*b* (e.g., a down-hole end), for example as illustrated in FIGS. 2A-2C, 3A-3C, and 4A-4C. The housing 210 may also be characterized as generally defining a longitudinal flowbore (e.g., the axial flowbore 200). In an embodiment, the housing 210 may be configured for connection to and/or incorporated with a string, such as the production string 150. For example, the housing 210 may comprise a suitable means of connection to the production string 150. For instance, in an embodiment the first terminal end 210*a* of the housing 210 may comprise internally and/or externally threaded surfaces as may be suitably employed in making a threaded connection to the production string 150. In an additional or alternative embodiment, the second terminal end 210*b* may also comprise internally and/or externally threaded surfaces as may be suitably employed in making a threaded connection to a down-hole portion of the production string 150. Alternatively, an ACA like ACA 100 may be incorporated within a production string like production string 150 by any suitable connection, such as for example, via one or more quick connector type connections. Suitable connections to a production string or tubular member will be known to those of skill in the art viewing this disclosure.

In an embodiment, the housing 210 may be configured to allow one or more sleeves (e.g., the upper sleeve 202, the intermediate sleeve 203, and the lower sleeve 204) to be slidably positioned therein. For example, in an embodiment, the housing 210 may generally comprise an upper cylindrical bore 210*c*, an intermediate cylindrical bore 210*d*, a downward interior surface 210*g*, an upward interior surface 210*h*, a first lower cylindrical bore 210*e*, and a second lower cylindrical bore 210*f*. In an embodiment, the upper cylindrical bore 210*c* may generally define an up-hole portion of the housing 210, for example, toward the first terminal end 210*a* of the housing 210. In an embodiment, the intermediate cylindrical bore 210*d* may generally define an intermediate portion of the housing 210, for example, extending at least some part of the way between the upper cylindrical bore 210*a* and the first lower cylindrical bore 210*e*. Additionally, in an embodiment, the intermediate cylindrical bore 210*d* may be generally characterized as having a diameter less than the diameter of the upper cylindrical bore 210*c* and the lower cylindrical bore 210*e*. In an embodiment, the downward interior surface 210*g* may generally define a downward facing surface of the housing 210 which joins the intermediate cylindrical bore 210*d* and the first lower cylindrical bore 210*e*. In an embodiment, the first lower cylindrical bore 210*e* may generally define a down-hole portion of the housing 210, for example, toward the second lower cylindrical bore 210*f* from the intermediate cylindrical bore 210*d*. In an embodiment, the second lower cylindrical bore 210*f* may generally define an even further down-hole portion of the housing 210, for example, extending from the first cylindrical bore 210*e* toward the second terminal end 210*b* of the housing 210.

Additionally, in an embodiment, the housing 210 may further comprise a plurality of ports (e.g., one, two, three, four, or more sets of ports, each set comprising one or more ports) configured to provide a route of fluid communication from the exterior of the housing 210 to the axial flowbore 200 of the housing 210 and/or from the axial flowbore 200 of the housing 210 to the exterior of the housing 210, when so-configured, as will be disclosed herein. For example, in the embodiments of FIGS. 2A-2C, 3A-3C, and 4A-4C, the housing 210 may comprise a run-in exterior port 212 and a circulation exterior port 218. Additionally, in the embodiments of FIGS. 2A-2C and 4A-4C, the housing 210 may further comprise a pressure release port 220, and a pressure port 227, as will be disclosed herein. Additionally, in the embodiments of FIGS. 3A-3C, the housing 210 may further comprise a second pressure release port 224, as will be disclosed herein. In an embodiment, one or more of the ports (e.g., the run-in exterior port 212, the circulation exterior port 218, the pressure release port 220, the secondary pressure release port 224, and/or the pressure port 227) may be of a suitable size (e.g., diameter), for example, so as to control and/or allow a desired and/or predetermined flow rate. For example, in an embodiment, one or more of the ports may comprise a nozzle, a valve, a cover, a fluidic diode, any other suitable flow rate and/or pressure altering component as would be appreciated by one of ordinary skill in the art upon viewing this disclosure, or combination thereof. For example, in the embodiments of FIGS. 3A-3C, the circulation exterior ports 218 may further comprise a nozzle, a reduced diameter, and/or any other suitable flow restrictor or flow rate reducing component as would be appreciated by one of ordinary skill in the art upon viewing this disclosure. Not intending to be bound by theory and as will be disclosed herein, a variation in the fluid flow rate of a fluid may cause an inverse variation on the pressure of the fluid. For example, a nozzle may be employed to restrict the flow rate of a fluid being communicated via any ports comprising such a nozzle, for example, from the axial flowbore 200 of the housing 210 to the exterior of the housing 210, thereby causing an increase in the pressure of the fluid within the axial flowbore 200 of the housing 210 and a pressure differential between the axial flowbore 200 of the housing 210 and the exterior of the housing 210, as will be disclosed herein.

Additionally, in an embodiment, one or more of the ports (e.g., the run-in exterior port 212, the circulation exterior port 218, the pressure release port 220, the secondary pressure release port 224, and/or the pressure port 227) may further comprise an actuatable cover, insert, or seal (e.g., a rupture disk). In such an embodiment, the actuatable cover may be configured such that in a first configuration the actuatable cover prohibits a route of fluid communication therethrough and in a second configuration (e.g., upon the failure of a rupture disk) the actuatable cover allows a route of fluid communication therethrough. In such an embodiment, the actuatable cover may be configured to transition from the first configuration to the second configuration upon the application of at least a threshold of pressure to the actuatable cover. For example, in the embodiments of FIGS. 2A-2C and 4A-4C, the pressure port 227 initially comprises a rupture disk 226, as shown in FIGS. 2A, 2B, 4A, and 4B.

In an embodiment, the valve 206 may be generally configured to close and/or seal one or more ports (e.g., the run-in exterior port 212, and optionally, the circulation exterior port 218) of the ACA 100 thereby prohibiting fluid communication in one direction (e.g., fluid communication from the axial flowbore 200 to the exterior of the ACA 100) and allowing fluid communication in the opposite direction (e.g., fluid communication from the exterior of the ACA 100 to the axial flowbore 200 of the ACA 100). In an embodiment, the valve 206 may be characterized as a one-way or unidirectional valve, for example, configured to allow fluid communication therethrough in only a single direction. For example, the valve 206 may comprise a check valve, a flutter valve, etc. In the embodiment of FIGS. 2A-2C, 3A-3C, and 4A-4C, the valve 206 comprises a compressible and/or deformable sleeve (e.g., an elastomeric sleeve). In such an embodiment, the elastomeric sleeve may be configured to be secured within the housing 210 (e.g., directly or indirectly), for example, within a recess (e.g., a generally cylindrical depression) within the housing 210, via an interlocking with a groove, recess, profile within the interior bore of the housing 210. Additionally, in the embodiments of FIGS. 2A-2C, 3A-3C, and 4A-4C, the valve 206 may be positioned within the housing 210 and configured to cover and/or block one or more ports (e.g., the run-in exterior ports 212). In such an embodiment, the valve 206 may be configured to allow fluid communication in the first direction (e.g., from the exterior of the ACA 100 to the axial flowbore 200) and to disallow fluid communication in the second direction (e.g., from the axial flowbore 200 to the exterior of the ACA 100). For example, in an embodiment, the valve 206 (e.g., an elastomeric sleeve) may be configured such that a fluid or pressure being communicating from the exterior of the ACA 100 to the axial flowbore 200 radially compresses the valve 206 (e.g., radially compresses or otherwise deforms the elastomeric sleeve), thereby allowing a route of fluid communication between the exterior of the ACA 100 and the axial flowbore 200. Further, in such an embodiment, the valve 206 may be configured such that a fluid or pressure being communicated from the axial flowbore 200 to the exterior of the ACA 100 radially expands the valve 206 (e.g., compresses the elastomeric sleeve against an inner surface of the housing 210), thereby blocking and/or disallowing a route of fluid communication between the exterior of the ACA 100 and the axial flowbore 200 via one or more ports (e.g., the run-in exterior ports 212).

In an additional or alternative embodiment, the ACA 100 may further comprise one or more additional valves (e.g., a second valve 207) configured to cover and/or seal one or more ports (e.g., the circulation exterior port 218, the pressure release port 220, and/or the secondary pressure release port 224, etc.). For example in the embodiment of FIGS. 4A-4C, the ACA 100 may further comprise the second valve 207 (e.g., an elastomeric sleeve) disposed about housing 210 and configured to cover and/or seal one or more ports (e.g., the circulation exterior ports 218). In such an embodiment, the second valve 207 may be configured to disallow fluid communication in the first direction (e.g., from the exterior of the ACA 100 to the axial flowbore 200) and to allow fluid communication in the second direction (e.g., from the axial flowbore 200 to the exterior of the ACA 100).

In an embodiment, each of the upper sleeve 202, the intermediate sleeve 203, and the lower sleeve 204 may generally comprise a cylindrical or tubular structure. Referring to FIGS. 2A-2C, 3A-3C, and 4A-4C, in an embodiment, the upper sleeve 202 may comprise a first upward-facing shoulder 202*c*, a first downward-facing shoulder 202*d*, a first upper outer cylindrical bore surface 202*a* extending between the first upward-facing shoulder 202*c* and the first downward-facing shoulder 202*d*, a downward-facing contact shoulder 202*e*, and a second upper cylindrical bore surface 202*b* extending between the first downward-facing shoulder 202*d* and the downward-facing contact shoulder 202*e*. In such an embodiment, the first sleeve 202 may be slidably positioned such that the first upper cylindrical bore surface 202*a* and the second upper cylindrical bore surface 202*b* are slidably fitted against at least a portion of an interior bore surface (e.g., the upper cylindrical bore 210*c* and the intermediate cylindrical bore surface 210*d*, respectively) of the housing 210 in a fluid-tight or substantially fluid-tight manner. Additionally, the first upper cylindrical bore surface 202*a*, the second upper cylindrical bore surface 202*b*, the upper cylindrical bore 210*c*, the intermediate cylindrical bore surface 210*d*, and/or any other surfaces of the housing 210 may further comprise one or more suitable seals 225 (e.g., an O-ring, a T-seal, a gasket, etc.) disposed at an interface between the first upper cylindrical bore surface 202*a* and the housing 210 and/or at an interface between the second upper cylindrical bore surface 202*b* and the housing 210, for example, for the purpose of prohibiting and/or restricting fluid movement via such an interface. In an embodiment, the diameter of the first upper cylindrical bore surface 202*a* may be greater than the diameter of the second upper cylindrical bore surface 202*b*.

In an embodiment (e.g., in the embodiments of FIGS. 2A-2C and 4A-4C, where the ASA comprises an intermediate sleeve), the intermediate sleeve 203 may comprise an intermediate upward-facing shoulder 203*b*, an intermediate downward-facing 203*c*, and an intermediate cylindrical bore surface 203*a* extending between the intermediate upward-facing shoulder 203*b* and the intermediate downward-facing shoulder 203*c*. In such an embodiment, the intermediate cylindrical bore surface 203*a* may be slidably positioned such that the intermediate cylindrical bore surface is slidably fitted against at least a portion of an interior bore surface (e.g. the intermediate cylindrical bore 210*d*) of the housing 210 in a fluid-tight or substantially fluid-tight manner. Additionally, the intermediate cylindrical bore surface 203*a* and/or the intermediate cylindrical bore 210*d* may further comprise one or more suitable seals 225 (e.g., an O-ring, a T-seal, a gasket, etc.) disposed at an interface between the intermediate cylindrical bore surface 203*a* and the housing 210, for example, for the purpose of prohibiting and/or restricting fluid movement via such an interface.

In an embodiment (e.g., in the embodiments of FIGS. 2A-2C and 4A-4C), the upper sleeve 202 and the intermediate sleeve 203 comprise separate, distributed components. In such an embodiment (e.g., the embodiments of FIGS. 2A-2C and 4A-4C), the intermediate sleeve 203 may further comprise a plurality of ports, for example, one or more run-in interior ports 214 and/or one or more circulation interior ports 216. In such an embodiment, the run-in interior ports 214 and/or the circulation interior ports 216 may be disposed radially about the intermediate sleeve 203, offset a longitudinal distance from each other (e.g., run-in interior ports 214 spaced longitudinally uphole from circulation interior ports 216) and may be configured to provide a route of fluid communication between the exterior of the intermediate sleeve 203 and the axial flowbore 200, when so-configured.

In an additional or alternative embodiment (e.g., in the embodiment of FIGS. 3A-3C), the intermediate sleeve is effectively integrated within the upper sleeve 202, thereby forming a single, unitary, non-distributed sleeve structure capable of similarly performing the function(s) disclosed herein. In such an embodiment (e.g., the embodiment of FIGS. 3A-3C), the upper sleeve 202 may further comprise a plurality of ports, for example, one or more run-in interior ports 214 and/or one or more circulation interior ports 216 as disclosed herein with respect to the intermediate sleeve 203. Additionally, in an embodiment (e.g., in the embodiment of FIGS. 3A-3C), the upper sleeve 202 may further comprise a third pressure port 229. In an embodiment, the third pressure port may be selectively blocked, for example, so as to not allow fluid communication therethrough when blocked and so as to allow fluid communication therethrough when unblocked. For example, in an embodiment, the third pressure port 229 may comprise a knockout (e.g., a "Kobe knockout"), a cap, a cover, a frangible member, or combinations thereof (e.g., a cap or cover removably retained by one or more frangible members). Also, in an embodiment the third pressure port 229 may be of a suitable size (e.g., diameter), for example, so as to control and/or allow a desired and/or predetermined flow rate. For example, in an embodiment, one or more of the ports may comprise a nozzle, a valve, a cover, a fluidic diode, any other suitable flow rate and/or pressure altering component as would be appreciated by one of ordinary skill in the art upon viewing this disclosure, or combination thereof.

In an embodiment, the lower sleeve 204 may comprise an upward-facing contact shoulder 204*f*, a second upward-facing shoulder 204*e*, a first downward-facing shoulder 204*g*, a second downward-facing shoulder 204*d*, a first lower cylindrical bore surface 204*a* extending between the upward-facing contact shoulder 204*f* and the second upward-facing shoulder 204*e*, a second lower cylindrical bore surface 204*b* extending between the second upward-facing shoulder 204*e* and the second downward-facing shoulder 204*d*, and a third lower cylindrical bore surface 204*c* extending between the first downward-facing shoulder 204*g* and the second downward-facing shoulder 204*d*. In such an embodiment, the first lower cylindrical bore surface 204*a*, the second lower cylindrical bore surface 204*b*, and the third lower cylindrical bore surface 204*c* may be slidably positioned such that the first lower cylindrical bore surface 204*a*, the second lower cylindrical bore surface 204*b*, and the third lower cylindrical bore surface 204*c* are slidably fitted against at least a portion of an interior bore surface (e.g., the intermediate cylindrical bore 210*d*, the first lower cylindrical bore 210*e*, and the second lower cylindrical bore 210*f*, respectively) of the housing 210 in a fluid-tight or substantially fluid-tight manner. Additionally, the first lower cylindrical bore surface 204*a*, the second lower cylindrical bore surface 204*b*, the third lower cylindrical bore surface 204*c*, the intermediate cylindrical bore 210*d*, the first lower cylindrical bore 210*e*, and/or the second lower cylindrical bore 210*f*, may further comprise one or more suitable seals 225 (e.g., an O-ring, a T-seal, a gasket, etc.) disposed at an interface between the first lower cylindrical bore surface 204*a* and the housing 210, at an interface between the second lower cylindrical bore surface 204*b* and the housing, at an interface between the third lower cylindrical bore surface 204*c* and the housing 210, or combinations thereof, for example, for the purpose of prohibiting and/or restricting fluid movement via such an interface. In an embodiment, the diameter of the second lower cylindrical bore surface 204*b* may be greater than the diameter of the first lower cylindrical bore surface 204*a* and/or the third lower cylindrical bore surface 204*c*. In an embodiment, the diameter of the first lower cylindrical bore surface 204*a* may be about the same as the diameter of the third lower cylindrical bore surface 204*c*.

In an embodiment (e.g., in the embodiments of FIGS. 2A-2C and 4A-4C), a first atmospheric chamber 222 may be generally defined by the first lower cylindrical bore 210*e*, downward interior surface 210*g*, the second upward-facing shoulder 204*e*, and the first cylindrical bore surface 204*a*. In an embodiment, the first atmospheric chamber 222 may be characterized as having a variable volume. For example, the volume of the first atmospheric chamber 222 may vary with movement of the lower sleeve 204 with respect to the housing 210, as will be disclosed herein.

Additionally or alternatively (e.g., in the embodiment of FIGS. 3A-3C), a second atmospheric chamber 223 may be generally defined by the upper cylindrical bore 210*c*, the upward interior surface 210*h*, the second upper cylindrical bore surface 202*b*, and the first downward-facing shoulder 202*d*. In an embodiment, the second atmospheric chamber 223 may be characterized as having a variable volume. For example, the volume of the second atmospheric chamber 223 may vary with movement of the upper sleeve 202 with respect to the housing 210, as will be disclosed herein.

Referring to the embodiments of FIGS. 2A-2C, 3A-3C, and 4A-4C, the upper sleeve 202, the intermediate sleeve 203, and/or the lower sleeve 204 may be slidably positioned within the housing 210. For example, the upper sleeve 202, the intermediate sleeve 203 (when present), and/or the lower sleeve 204 may each be slidably movable between various longitudinal positions with respect to the housing 210 and/or with respect to each other. Additionally, the relative longitudinal position of the upper sleeve 202, the intermediate sleeve 203, and/or the lower sleeve 204 may determine if one or more ports (e.g., a given set of ports, for example, the run-in exterior port 212, the circulation exterior port 218, the pressure release port 220, and/or the secondary pressure release port 224) of the housing 210 are able to provide a route of fluid communication between the axial flowbore 200 and the exterior of the ACA 100 (e.g., in one or both directions).

Referring to the embodiments of FIGS. 2A, 3A, and 4A, when the ACA is configured in the first configuration, the upper sleeve 202 is in a first position with respect to the housing 210 (e.g., a relatively upper position). In such an embodiment, the upper sleeve 202 may be coupled releasably to the housing 210, for example, via a shear pin, a snap ring, etc., for example, such that the upper sleeve 202 is retained in the first position relative to the housing 210. For example, in the embodiments of FIGS. 2A, 3A, and 4A, the upper sleeve 202 is coupled to the housing via a shear pin 208.

In an embodiment (e.g., the embodiments of FIGS. 2A and 4A), the intermediate sleeve 203 may be positioned in a first position with respect to the housing 210 (e.g., in a relatively upper position). In an embodiment, the intermediate sleeve 203 may be retained in the first position relative to the housing 210, for example, via a frictional interaction between intermediate sleeve 203 and the housing 210 (e.g., a "interference bump") or via a shear pin, a snap ring, compressed pin, etc. In an embodiment, both the upper sleeve 202 and the intermediate sleeve 203 may be retained (e.g., as disclosed herein) in the respective, first positions; alternatively, the intermediate sleeve 203 may be retained in the first position (e.g., via a shear-pin or the like) while movement of the upper sleeve 202 is generally impeded by the intermediate sleeve 203. In an embodiment, when the upper sleeve 202 (in the embodiment of FIG. 3B) and/or the intermediate sleeve 203 (in the embodiment of FIGS. 2B and 4B) is in the first position, the upper sleeve 202 and/or the intermediate sleeve 203 may be positioned such that the run-in exterior ports 212 and the run-in interior ports 214 are aligned in fluid communication and, for example, thereby provide a route of fluid communication from the exterior of the ACA 100 to the axial flowbore 200, for example, via the run-in exterior ports 212, the valve 206, and the run-in interior ports 214 (e.g., while the valve 206 blocks fluid communication in the opposite direction). Additionally, in an embodiment (e.g., the embodiments of FIGS. 2A and 4A), the upper sleeve 202 and the intermediate sleeve 203 may be positioned substantially adjacent to and/or abutted with each other (e.g., the downward-facing shoulder 202*e* of the upper sleeve 202 and the upward-facing shoulder 203*b* of the intermediate sleeve 203). Further, in an embodiment (e.g., the embodiments of FIGS. 2A and 4A), the lower sleeve 204 may be positioned in a first position (e.g., a relatively lower position) with respect to the housing 210. In such an embodiment, the lower sleeve 204 may be configured such that the lower sleeve 204 does not engage, abut, and/or contact the intermediate sleeve 203. In an alternative embodiment (e.g., the embodiment of FIG. 3A), the lower sleeve 204 may be positioned in a second position (e.g., a relatively upper position) with respect to the housing 210.

Referring to the embodiments of FIGS. 2B, 3B, and 4B, when the ACA 100 is configured in the second configuration, the upper sleeve 202 may be in a second position with respect to the housing 210 (e.g., in a relatively lower position). In such an embodiment, the upper sleeve 202 may be no longer coupled to the housing 210, for example, via the shear pins 208. Additionally, in an embodiment (e.g., the embodiment of FIGS. 2B and 4B), the intermediate sleeve 203 is in a second position with respect to the housing 210 (e.g., in a relatively lower position). In an embodiment, when the upper sleeve 202 (e.g., in the embodiment of FIG. 3B) and/or the intermediate sleeve 203 (e.g., in the embodiments of FIGS. 2B and 4B) is in the second position, the upper sleeve 202 (in FIG. 3B) and/or the intermediate sleeve 203 (in FIGS. 2B and 4B) may be positioned such that the circulation exterior ports 218 of the housing 210 and the circulation interior ports 216 of the intermediate sleeve 203 are aligned and, in some embodiments, provide bidirectional fluid communication between the exterior of the ACA 100 and the axial flowbore 200, for example, via the circulation exterior ports 218 and the circulation interior ports 216. Additionally, in such an embodiment, the upper sleeve 202 (in FIG. 3B) and/or the intermediate sleeve 203 (in FIGS. 2B and 4B) may be configured to disallow (e.g., no longer allow) a route of fluid communication via the run-in exterior ports 212, the valve 206, and the run-in interior ports 214. In such an embodiment (e.g., the embodiments of FIGS. 2A and 4A), the upper sleeve 202 and the intermediate sleeve 203 may be positioned substantially adjacent and/or abutted with each other (e.g., the downward-facing shoulder 202*e* of the upper sleeve 202 and the upward-facing shoulder 203*b* of the intermediate sleeve 203). Additionally, in an embodiment (e.g., the embodiments of FIGS. 2A and 4A), the lower sleeve 204 is (e.g., remains) in the first position with respect to the housing 210. In such an embodiment, the intermediate sleeve 203 and the lower sleeve 204 may be positioned substantially adjacent and/or abutted with each other (the intermediate downward-facing contact shoulder 203*c* of the intermediate sleeve 203 and the upward-facing contact shoulder 204*f* of the lower sleeve 204). Alternatively, in an embodiment (e.g., in the embodiment of FIG. 3B), the lower sleeve 204 is moved to the first position, for example, upon coming into contact with and being moved by the upper sleeve 202 (e.g., abutment between the downward-facing shoulder 202*e* of the upper sleeve 202 and the upward-facing contact shoulder 204*f* of the lower sleeve 204.

Referring to the embodiments of FIGS. 2C, 3C, and 4C, when the ACA 100 is configured in the third configuration, the upper sleeve 202 is in a third position with respect to the housing 210 (e.g., in a relatively intermediate longitudinal position). Additionally, in an embodiment (e.g., the embodiments of FIGS. 2C and 4C), the intermediate sleeve 203 is in a third position with respect to the housing 210 (e.g., in a relatively intermediate longitudinal position). In an embodiment, when the upper sleeve 202 (e.g., in FIG. 3C) and/or the intermediate sleeve 203 (e.g., in FIGS. 2C and 4C) is in the third configuration, the upper sleeve 202 (in FIG. 3C) and/or the intermediate sleeve 203 (in FIGS. 2C and 4C) is positioned to prohibit a route of fluid communication between the exterior of the ACA 100 and the axial flowbore 200. For example, the upper sleeve 202 and/or intermediate sleeve 203 may be configured to disallow (e.g., no longer allow) a route of fluid communication via the run-in exterior ports 212, the valve 206, and the run-in interior ports 214 and/or the circulation exterior ports 218 and the circulation interior ports 216. In such an embodiment (e.g., in the embodiment of FIGS. 2C and 4C), the upper sleeve 202 and the intermediate sleeve 203 may be positioned substantially adjacent and/or abutted with each other (e.g., the downward-facing shoulder 202*e* of the upper sleeve 202 and the upward-facing shoulder 203*b* of the intermediate sleeve 203). Additionally, in an embodiment, the lower sleeve 204 is in a second position with respect to the housing 210. In such an embodiment, the upper sleeve 202 or the intermediate sleeve 203 may be positioned substantially adjacent and/or abutted with the lower sleeve 204.

In an embodiment, the upper sleeve 202, the intermediate sleeve 203, and the lower sleeve 204 may each be configured so as to be selectively moved downward (e.g., towards the second terminal end 210*b*) and/or upwardly (e.g., towards the first terminal end 210*a*). For example, in the embodiments of FIGS. 2A-2C and 4A-4C, the ACA 100 may be configured such that an application of a fluid pressure to the axial flowbore 200 (alternatively, a decrease in the pressure applied to the exterior of the ACA 100) causes a differential fluid pressure between the axial flowbore 200 and the exterior of the housing 210 (e.g., in which the pressure applied to the axial flowbore 200 is greater than the pressure applied to the exterior of the housing 210 by at least the first threshold pressure) and results in a net hydraulic force applied to the upper sleeve 202 (and, thereby, to the intermediate sleeve 203) in the axially downward direction (e.g., in the direction towards the second terminal end 210*b*). In such an embodiment, the ACA 100 may be configured such that the differential fluid pressure between the axial flowbore 200 and the exterior of the housing 210 will cause the upper sleeve 202 and, thereby, the intermediate sleeve 203, to move from the first position to the second position with respect to the housing 210 and, thus, transitioning the ACA 100 from the first configuration to the second configuration. In an embodiment, the lower sleeve 204 may be configured such that the application of fluid pressure to the axial flowbore 200 (e.g., the differential fluid pressure in which the pressure applied to the axial flowbore 200 is greater than the pressure applied to the exterior of the housing 210) does not move the lower sleeve 204 from the first position with respect to the housing 210. Alternatively, in an embodiment such an application of fluid pressure may result in movement of the lower sleeve 204 from the first position.

Alternatively, in the embodiment of FIG. 3A-3C, the ACA 100 may be configured such that such that an application of a fluid pressure of at least a first threshold to the axial flowbore 200 results in a net hydraulic force applied to the upper sleeve 202 in the axially downward direction (e.g., in the direction towards the second terminal end 210*b*). For example, in such an embodiment, the upward-facing surfaces of the upper sleeve 202 that are exposed to the axial flowbore 200 may comprise a greater surface area than the downward-facing surfaces of the upper sleeve 202 that are exposed to the axial flowbore (e.g., because of the second atmospheric chamber 223), thereby resulting in the net downward force applied to the upper sleeve 202 upon the application of fluid pressure to the axial flowbore 200. Also, in the embodiment of FIG. 3A, the upper sleeve 202 may be configured such that, upon movement of the upper sleeve 202 from the first position to the second position, as disclosed herein, may result in a route of fluid communication via the third pressure port 229. For example, in the embodiment of FIG. 3A, the third pressure port is initially blocked (e.g., via a Kobe knock-out, cap, cover, or the like). Upon movement of the upper sleeve 202 from the first position to the second position, the Kobe knock-out, cap, cover, or the like is removed (e.g., via an interaction with the housing 210), thereby allowing a route of fluid communication through the third pressure port 229. Additionally, in the embodiment of FIGS. 3A-3C, movement of the upper sleeve 202 from the first position to the second position may cause the upper sleeve 202 to contact and/or abut the lower sleeve 204, for example, thereby moving the lower sleeve 204 in the axially downward direction (e.g., in the direction towards the second terminal end 210*b*).

In the embodiments of FIGS. 2A-2C and 4A-4C, the ACA 100 may be further configured such that a second application of fluid pressure of at least the second threshold pressure to the exterior of the housing 210 (which may or may not result in a differential fluid pressure between the axial flowbore 200 and the exterior of the housing 210, in which the pressure applied to the axial flowbore 200 is less than the pressure applied to the exterior of the housing 210 by at least the second threshold pressure) and results in a net hydraulic force applied to the lower sleeve 204 in the axially upward direction (e.g., in the direction of towards the first terminal end 210*a*), thereby causing the lower sleeve 204 to move from the first position to the second position with respect to the housing 210. For example, in such an embodiment, the atmospheric chamber 222 may be unexposed to fluid pressure within the axial flowbore 200 and/or the exterior of the housing 210, thereby resulting in a differential in the force applied to the lower sleeve 204 in the direction towards the second position (e.g., an upward force) and the force applied to the lower sleeve 204 in the direction away from the second position (e.g., a downward force).

In the embodiment of FIGS. 3A-3C, the ACA 100 may be further configured such that an increase in fluid velocity via the axial flowbore (e.g., an increase in the volume of fluid pumped into and/or therethrough) results in an increase in fluid pressure within the axial flowbore 200, for example, thereby causing a differential fluid pressure between the axial flowbore 200 and the exterior of the housing 210 and resulting in a net hydraulic force applied to the lower sleeve 204 in the axially upward direction (e.g., in the direction of towards the first terminal end 210*a*). For example, in an embodiment of FIGS. 3B-3C, the circulation exterior port 218 and/or circulation interior ports 216 may be at least partially restricted (e.g., so as to allow passage of a fluid therethrough at not more than a predetermined rate). For example, the ACA 100 may be configured such that an increase in fluid flow rate applied to the ACA 100 (e.g., through the axial flowbore 200) increases the fluid pressure within the axial flowbore 200 (e.g., because fluid cannot escape through the circulation exterior port 218 and/or circulation interior ports 216 at more than the predetermined rate), thereby moving the lower sleeve 204 from the first position to the second position with respect to the housing 210. In such an embodiment, such an application of fluid pressure (e.g., via an increased flowrate) of at least the second pressure threshold to the axial flowbore 200 causes a differential fluid pressure between the axial flowbore 200 and the exterior of the housing 210 and, thereby results in a net hydraulic force applied to the lower sleeve 204 in the axially upward direction (e.g., in the direction of towards the first terminal end 210*a*). Additionally, in such an embodiment, when the lower sleeve 204 moves from the first position to the second position with respect to the housing 210, the upper sleeve 202 may be configured to move from the second position to the third position, for example, via an application of force applied by the lower sleeve 204 onto the upper sleeve 202. Also, and not intending to be bound by theory, because the third pressure port 229 allows fluid communication therethrough (e.g., upon movement of the upper sleeve 202 from the first position to the second position, as disclosed herein), the upper sleeve 202 will no longer exert a net downward force upon the application of a fluid pressure to the axial flowbore 200.

One or more embodiments of an ACA (e.g., such as ACA 100) and/or a wellbore completion system (e.g., such as wellbore completion system 180) comprising such an ACA 100 having been disclosed, one or more embodiments of a wellbore servicing method employing such a wellbore completion system 180 and/or such a ACA 100 are also disclosed herein. In an embodiment, a wellbore servicing method may generally comprise the steps of positioning a production string (e.g., such as production string 150) having a ACA 100 incorporated therein within a completion and/or casing string (e.g., such as completion string 190) and/or a wellbore (e.g., such as wellbore 114), transitioning the ACA 100 so as to provide a flow path for fluid circulation from and/or, optionally, to the axial flowbore 200 of the ACA 100, and disabling the ACA 100 so as to disallow fluid communication between the axial flowbore 200 and the exterior of the ACA 100 (e.g., the axial flowbore 191 of the completion string 190 and/or the wellbore 114).

As will be disclosed herein, the ACA 100 may control fluid movement through the production string 150 and/or ACA 100 during the wellbore servicing operation. For example, as will be disclosed herein, during the step of positioning the production string 150 within the axial flowbore 191 of the completion string 190 and/or the wellbore 114, the ACA 100 may be configured to allow fluid communication from the axial flowbore 191 of the completion string 190 and/or the wellbore 114 into the axial flowbore 200 and to disallow fluid communication from the axial flowbore 200 to the axial flowbore 191 of the completion string 190 and/or the wellbore 114. Also, for example, during the step of transitioning the ACA 100 to provide a flow path for fluid circulation from the axial flowbore 200 of the ACA 100, the ACA 100 may be configured to allow fluid communication from the axial flowbore 191 of the completion string 190 and/or the wellbore 114 to the axial flowbore 200 and/or fluid communication from the axial flowbore 200 to the axial flowbore 191 of the completion string 190 and/or the wellbore 114, as will be disclosed herein. Also, during the step of disabling the ACA 100, the ACA 100 may be configured to prohibit fluid communication between the axial flowbore 200 and the axial flowbore 191 of the completion string 190 and/or the wellbore 114 via the ACA 100.

In an embodiment, positioning a production string 150 comprising the ACA 100 may comprise forming and/or assembling the components of the production string 150, for example, as the production string 150 which may be assembled and run into the wellbore 114. The production string 150 having the ACA incorporated/integrated therein is run into the axial flowbore 191 of the completion string 190 and/or the wellbore 114. For example, referring to FIG. 1, the ACA 100 is incorporated within the production string 150 via a suitable tubular adapter as would be appreciated by one of ordinary skill in the art upon viewing this disclosure.

In an embodiment, the production string 150 may be run into the completion string 190 and/or the wellbore 114 with the ACA 100 configured in the first configuration, for example, with each of the upper sleeve 202, the intermediate sleeve 203, and the lower sleeve 204 in the first position with respect to the housing 210 as disclosed herein and as illustrated in embodiments of FIGS. 2A, 3A, and 4A. In such an embodiment, with the ACA 100 configured in the first configuration, the ACA 100 will allow a route of fluid and/or pressure communication in the first direction from the exterior of the ACA 100 (e.g., from the axial flowbore 191 of the completion string 190 and/or the wellbore 114) to an axial flowbore 200 of the ACA 100 and not in the second direction from the axial flowbore 200 of the ACA 100 to the exterior of the ACA 100. For example, as shown in the embodiments of FIGS. 2A, 3A, and 4A, when the ACA 100 is configured in the first configuration a fluid or pressure may be allowed to enter the axial flowbore 200 of the ACA 100 via the run-in exterior ports 212, the valve 206, and the run-in interior ports 214. As such, in an embodiment, the ACA 100 may be configured so as to all the production string 150 to fill (e.g., to "autofill") with fluids already present within the axial flowbore 191 of the completion string 190 and/or the wellbore 114 during run-in. Additionally, in an embodiment, the production string 150 may be run into the axial flowbore 191 of the completion string 190 and/or the wellbore 114 to a desired depth and may be positioned proximate to one or more desired subterranean formation zones.

In an embodiment, transitioning the ACA 100 to provide a flow path for fluid circulation from the axial flowbore 200 of the ACA 100 may comprise transitioning the ACA 100 from the first configuration to the second configuration, for example, transitioning the upper sleeve 202 (in the embodiment of FIGS. 3A-3C) or the upper sleeve 202 and the intermediate sleeve 203 (in the embodiments of FIGS. 2A-2C and 4A-4C) from the first position to the second position with respect to the housing 210. In an embodiment, transitioning the ACA 100 may comprise applying a fluid pressure to the axial flowbore 200 of the ACA 100. Additionally or alternatively, in an embodiment transitioning the ACA 100 may comprise causing the pressure applied to the exterior of the housing 210 to be decreased, for example, thereby causing a differential pressure between the axial flowbore 200 and the exterior of the housing 210. For example, in an embodiment, the first downward-facing shoulder 202*d* may be unexposed to the axial flowbore 200 while all other faces capable of applying a force are exposed (e.g., the first upward-facing shoulder 202*c*), thereby providing a differential in the force applied to the upper sleeve 202 in the direction towards the second position (e.g., a downward force) and the force applied to the upper sleeve 202 in the direction away from the second position (e.g., an upward force). In an embodiment, the net hydraulic force applied to the upper sleeve 202 may be effective to transition the upper sleeve 202 (in the embodiment of FIGS. 3A-3C) or the upper sleeve 202 and the intermediate sleeve 203 (in the embodiments of FIGS. 2A-2C and 4A-4C) from the first position to the second position with respect to the housing 210. As disclosed herein, the application of fluid or hydraulic pressure to the ACA 100 may yield a force in the direction of the second position. For example, in an embodiment, the fluid or hydraulic pressure may be of a magnitude sufficient to exert a force to shear one or more shear pins 208, thereby causing the upper sleeve 202 to move relative to the housing 210 and (e.g., in the embodiments of FIGS. 2A-2C and 4A-4C) to apply a force onto the intermediate sleeve 203 (e.g., via abutment and/or engagement between the downward-facing contact shoulder 202*e* and the intermediate upward-facing shoulder 203*b*) in the direction of the second position. In an embodiment, as illustrated in FIGS. 2B, and 4B, the upper sleeve 202 may continue to move in the direction of the second position until the first downward-facing shoulder 202*d* of the upper sleeve 202 contacts and/or abuts the upward interior surface 210*h* of the housing 210 and/or the intermediate downward-facing contact shoulder 203*c* of the intermediate sleeve 203 contacts and/or abuts the upward-facing contact shoulder 204*f* of the lower sleeve 204, thereby prohibiting the upper sleeve 202 from continuing to slide. In another embodiment, as illustrated in FIG. 3B, the upper sleeve 202 may continue to move in the direction of the second position until the first downward-facing shoulder 202*d* of the upper sleeve 202 contacts and/or abuts the upward interior surface 210*h* of the housing 210 and/or upper sleeve 202 contacts and/or abuts the lower sleeve 204.

In the embodiments of FIGS. 2B and 3B, when the ACA 100 is in the second configuration, the ACA 100 will allow bidirectional fluid and/or pressure communication between the exterior of the ACA 100 and the axial flowbore 200 of the ACA 100. In the embodiment of FIG. 4B, the ACA 100 (e.g., via the action of the second valve 207) will allow a route of fluid and/or pressure communication in the second direction from the axial flowbore 200 of the ACA 100 to exterior of the ACA 100 and not in the first direction from the exterior of the ACA 100 to the axial flowbore 200 of the ACA 100. In such embodiments, a hydraulic fluid may be circulated from the axial flowbore 200 of the ACA 100 via the axial flowbore 191 of the completion string 190 and/or the wellbore 114 to the earth's surface 104 via the circulation aligned interior ports 216 and the circulation exterior ports 218. For example, in an embodiment, a dense fluid contained within the axial flowbore 200 of the ACA 100 may be circulated to the earth's surface 104 via the circulation interior ports 216 and the circulation exterior ports 218 and a less dense fluid may be pumped into the axial flowbore 200 of the ACA 100 via the axial flowbore 115 of the production string 150.

In an embodiment, disabling the ACA 100 to disallow fluid communication between the axial flowbore 200 and the exterior of the ACA 100 (e.g., the axial flowbore 191 of the completion string 190 and/or the wellbore 114) may comprise transitioning the ACA 100 from the second configuration to the third configuration, for example, by transitioning the lower sleeve 204 from the first position to the second position with respect to the housing 210 so as to transition the upper sleeve 202 and the intermediate sleeve 203 from the second position to the third position with respect to the housing 210. In the embodiment of FIGS. 2C, 3C, and 4C, the ACA 100 is configured in the third configuration, thereby disallowing fluid communication between the axial flowbore 191 of the completion string 190 and/or the wellbore 114 and the axial flowbore 200 of the ACA 100.

In the embodiments of FIGS. 2B and 4B, disabling the ACA 100 to disallow fluid communication between the axial flowbore 200 and the exterior of the ACA 100 may comprise applying a fluid pressure to the axial flowbore 200 and/or the exterior of the housing 210 (additionally or alternatively, causing the pressure applied to the axial flowbore 200 to be decreased). In an embodiment, the fluid pressure may be of a magnitude sufficient to exert a force to actuate (burst or break) the rupture disk 226, thereby allowing the fluid pressure to flow through the pressure port 227. In such an embodiment, the atmospheric chamber 222 may be unexposed to fluid pressure within the axial flowbore 200 and/or the exterior of the housing 210 while all other faces capable of applying a force are exposed (e.g., the second downward-facing shoulder 204*d*), thereby providing a differential in the force applied to the lower sleeve 204 in the direction towards the second position (e.g., an upward force) and the force applied to the lower sleeve 204 in the direction away from the second position (e.g., a downward force). In an embodiment, the net hydraulic force applied to the lower sleeve 204 may be effective to transition the lower sleeve 204 from the first position to the second position with respect to the housing 210. Additionally, in such an embodiment, transitioning the lower sleeve 204 to the second position may apply a force onto the intermediate downward-facing shoulder 203*c* of the intermediate sleeve 203, and thereby transition the upper sleeve 202 and the intermediate sleeve 203 to the third position in which no fluid communication in to or out of the ACA is allowed.

Alternatively, in the embodiment of FIG. 3B, disabling the ACA 100 to disallow fluid communication between the axial flowbore 200 and the exterior of the ACA 100 may comprise communicating a fluid through the axial flowbore 200 at a predetermined flow rate. In such an embodiment, where the ACA 100 is in the second configuration and where the circulation exterior ports 218 and/or the circulation interior ports 216 are at least partially restricted, the fluid flow rate through the axial flowbore 200 of the ACA 100 may cause an increase in the fluid pressure within the axial flowbore 200, thereby causing a net upward force to be applied to the lower sleeve 204. For example, in an embodiment, the second upward-facing shoulder 204*e* of the lower sleeve 204 may be unexposed to the axial flowbore 200 while all other faces capable of applying a force are exposed (e.g., the second downward-facing shoulder 204*d* of the lower sleeve 204), thereby providing a differential in the force applied to the lower sleeve 204 in the direction towards the second position (e.g., an upward force) and the force applied to the lower sleeve 204 in the direction away from the second position (e.g., an downward force). In an embodiment, the net hydraulic force applied to the lower sleeve 204 may be effective to transition the lower sleeve 204 from the first position to the second position with respect to the housing 210. As disclosed herein, the application of fluid or hydraulic pressure to the ACA 100 may yield a force in the direction of the second position. Additionally, in such an embodiment, transitioning the lower sleeve 204 to the second position may apply a force onto the intermediate downward-facing shoulder 202*e* of the upper sleeve 202, and thereby transition the upper sleeve 202 to the third position.

Additionally, in the embodiments of FIGS. 2C, 3C, and 4C, the lower sleeve 204 may continue to move in the direction of the second position until the second upward-facing shoulder 204*e* of the lower sleeve 204 contacts and/or abuts the downward interior surface 210*g* of the housing 210, thereby prohibiting the lower sleeve 204 from continuing to slide. In an additional or alternative embodiment, the lower sleeve 204 may comprise one or more snap rings, compressed pins, and/or frictional interfaces disposed about the first lower cylindrical bore surface 204*a*, the second lower cylindrical bore surface 204*b*, and/or the third lower cylindrical bore surface 204*c* which may engage with a groove or slot on one or more interior surfaces of the housing 210 (e.g., the intermediate cylindrical bore 210*d*, the first lower cylindrical bore 210*e*, and the second lower cylindrical bore 2100, thereby prohibiting the lower sleeve 204 from continuing to slide and/or from sliding in the direction of the first position.

Additionally, in an embodiment, once the production string 150 comprising the ACA 100 has been positioned within the axial flowbore 191 of the completion string 190 and/or the wellbore 114, one or more of the adjacent zones may be isolated and/or the production string 150 may be secured (e.g., within the completion string 190 or the formation 102). In an embodiment, the adjacent zones may be separated by one or more suitable wellbore isolation devices. Suitable wellbore isolation devices are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof. In an alternative embodiment, only a portion of the zones may be isolated, alternatively, the zones may remain unisolated.

Additionally, in an embodiment, the method may further comprise producing a formation fluid, for example, via the production string 150.

In an embodiment, an ACA (like ACA 100), a system utilizing an ACA, and/or a method utilizing such an ACA and/or system a system may be advantageously employed in the performance of a wellbore servicing operation. For example, as disclosed herein, the ACA allows for a production string (or other tubular) comprising an ACA to be placed within a wellbore such that the ACA allows one-way fluid communication into the ACA and/or production string (e.g., autofilling), thereby maintaining a wellbore pressure integrity, reducing pressure surges on weak formations, reducing costly mud losses, and/or increasing the production string "run-in" speeds. Additionally, the ACA may be employed to circulate a fluid contained the ACA to the surface. Conventional wellbore completion tools do not provide the ability to be configured from first, a run-in configuration in which fluid communication in to the tool is allowed to a second configuration which allows fluid circulation via the production string and, finally, to a third configuration in which no fluid communication in to or out of the tool is allowed. Further, the ACA may provide the ability to close and/or seal the ACA thereby disallowing fluid communication via the ACA. As such, the presently disclosed ACA may permit an operator to selectively run-in a production string while the production string automatically fills with wellbore fluids, to circulate a fluid contained within the production string, and to close or seal the production string.

It should be understood that the various embodiments previously described may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

Additional Disclosure

The following are non-limiting, specific embodiments in accordance with the present disclosure:

A first embodiment, which is a wellbore completion system comprising:

- a tubular string disposed within a wellbore;
- an autofill and circulation assembly (ACA) incorporated within the tubular string and comprising:
  - a housing generally defining an axial flowbore and comprising a first flow port and a second flow port extending between the axial flowbore and an exterior of the housing; and
  - a first sleeve slidably positioned within the housing and transitional from a first longitudinal position to a second longitudinal position and from the second longitudinal position to a third longitudinal position;
    - wherein, when the first sleeve is in the first position, the ACA is configured to allow a route of fluid communication from the exterior of the housing to the axial flowbore via the first flow port and to not allow a route of fluid communication from the axial flowbore to the exterior of the housing via the first flow port;
    - wherein, when the first sleeve is in the second position, the ACA is configured to allow a bidirectional route of fluid communication between the exterior of the housing and the axial flowbore via the second flow port; and
    - wherein, when the first sleeve is in the third position, the ACA is configured to disallow a route of fluid communication between the exterior of the housing and the axial flowbore.

A second embodiment, which is the system of the first embodiment, wherein the ACA further comprises a first valve disposed within the housing to allow a route of fluid communication via the first flow port from the exterior of the housing to the axial flowbore and to not allow a route of fluid communication via the first flow port from the axial flowbore to the exterior of the housing.

A third embodiment, which is the system of one of the first through the second embodiments, wherein the valve comprises a deformable sleeve.

A fourth embodiment, which is the system of one of the first through the third embodiments, wherein the ACA further comprises an upper sleeve slidably positioned within the housing and transitional from a first longitudinal position to a second longitudinal position upon the ACA experiencing a first pressure differential in which the pressure applied to the axial flowbore is greater than the pressure applied to the exterior of the housing by at least a first threshold pressure.

A fifth embodiment, which is the system of the fourth embodiment, wherein movement of the upper sleeve from the first longitudinal position to the second longitudinal position is effective to transition the first sleeve from the first position to the second longitudinal position.

A sixth embodiment, which is the system of one of the fourth through the fifth embodiments, wherein the ACA further comprises a lower sleeve slidably positioned within the housing and transitional from a first longitudinal position to a second longitudinal position upon the ACA experiencing an application of pressure to the exterior of the housing of at least a second threshold pressure.

A seventh embodiment, which is the system of the sixth embodiment, wherein movement of the lower sleeve from the first longitudinal position to the second longitudinal position is effective to transition the first sleeve from the second longitudinal position to the third longitudinal position.

An eighth embodiment, which is the system of one of the fourth through the fifth embodiments, wherein the ACA further comprises a lower sleeve slidably positioned within the housing and transitional from a first longitudinal position to a second longitudinal position upon a fluid being communicated through the axial flowbore at a predetermined rate.

A ninth embodiment, which is the system of the eighth embodiment, wherein the ACA is configured such that movement of the lower sleeve from the first longitudinal position to the second longitudinal position is effective to transition the second sleeve from the second longitudinal position to the third longitudinal position.

A tenth embodiment, which is the system of one of the first through the ninth embodiments, wherein the first sleeve further comprises a first sleeve port, wherein the first sleeve port is in fluid communication with the first flow port when the first sleeve is in the first position.

An eleventh embodiment, which is the system of the tenth embodiment, wherein the first sleeve further comprises a second sleeve port, wherein the second sleeve port is in fluid communication with the second flow port when the first sleeve is in the second position.

A twelfth embodiment, which is the system of one of the first through the eleventh embodiments, further comprising:

a packer disposed about the tubular string and up-hole relative to the ACA; and a plug incorporated with the tubular string and down-hole relative to the ACA.

A thirteenth embodiment, which is the system of the second embodiment, further comprising a second valve disposed about the housing to allow a route of fluid communication via the second flow port from the axial flowbore to the exterior of the housing flow port and to not allow a route of fluid communication via the second flow port from the exterior of the housing to the axial flowbore.

A fourteenth embodiment, which is the system of one of the first through the thirteenth embodiments, further comprising a flow restrictor coupled with the second flow port.

A fifteenth embodiment, which is a wellbore completion method comprising:

positioning a tubular string comprising an autofill and circulation assembly (ACA) within a wellbore, wherein the ACA is positioned within the wellbore in a first configuration, wherein, when the ACA is in the first configuration, the ACA allows a route of fluid communication from an exterior of the ACA to an axial flowbore of the ACA and to not allow a route of fluid communication from the axial flowbore to the exterior of the housing;

causing the ACA to experience a first pressure differential in which the pressure applied to the axial flowbore is greater than the pressure applied to the exterior of the housing by at least a first threshold pressure so as to transition the ACA from the first configuration to a second configuration;

communicating a fluid from the axial flowbore to the exterior of the housing, communicating a fluid from the exterior of the housing to the axial flowbore, or combinations thereof; and transitioning the ACA from the second configuration to a third configuration, wherein, when the ACA is in the third configuration, the ACA disallows a route of fluid communication between the exterior of the ACA and the axial flowbore the ACA.

A sixteenth embodiment, which is the method of the fifteenth embodiment, wherein transitioning the ACA from the second configuration to a third configuration comprises applying a pressure to the exterior of the housing of at least a second threshold pressure.

A seventeenth embodiment, which is the method of one of the fifteenth through the sixteenth embodiments, wherein transitioning the ACA from the second configuration to a third configuration comprises communicating a fluid through the axial flowbore at a predetermined rate.

An eighteenth embodiment, which is a wellbore completion tool comprising generally defining an axial flowbore, wherein the wellbore completion tool is selectively transitioned from a first configuration to a second configuration and from the second configuration to a third configuration, wherein, when the wellbore completion tool is in the first configuration, the wellbore completion tool allows fluid communication from an exterior of the tool to the axial flowbore and to not allow fluid communication from the axial flowbore to the exterior of the tool, wherein, when the wellbore completion tool is in the second configuration, the wellbore completion tool allows fluid communication from the axial flowbore to the exterior of the tool, wherein, when the wellbore completion tool is in the third configuration, the wellbore completion tool does not allow fluid communication between the axial flowbore and the exterior of the tool, wherein, the wellbore completion tool selectively transitions from the first configuration to the second configuration upon experiencing a first pressure differential in which the pressure applied to the axial flowbore is greater than the pressure applied to the exterior of the tool by at least a first threshold pressure, upon a pressure of at least a first threshold pressure being applied to the axial flowbore, or combinations thereof, and wherein, the wellbore completion tool selectively transitions from the second configuration to the third configuration upon experiencing a pressure of at least a second threshold pressure applied to the exterior of the tool, upon a fluid being communicated through the axial flowbore at a predetermined rate, or combinations thereof.

A nineteenth embodiment, which is the wellbore completion tool of the eighteenth embodiment, wherein the tool comprises a housing generally defining an axial flowbore and comprising a first flow port and a second flow port extending between the axial flowbore and an exterior of the housing; and a first sleeve slidably positioned within the housing and transitional from a first longitudinal position to a second longitudinal position and from the second longitudinal position to a third longitudinal position.

A twentieth embodiment, which is the wellbore completion tool of the nineteenth embodiment, wherein the first sleeve further comprises a first sleeve port, wherein the first sleeve port is in fluid communication with the first flow port when the first sleeve is in the first position.

A twenty-first embodiment, which is the wellbore completion tool of the twentieth embodiment, wherein the first sleeve further comprises a second sleeve port, wherein the second sleeve port is in fluid communication with the second flow port when the first sleeve is in the second position.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore completion system comprising:

a tubular string disposed within a wellbore;

an autofill and circulation assembly (ACA) incorporated within the tubular string and comprising:

a housing generally defining an axial flowbore and comprising a first flow port and a second flow port extending between the axial flowbore and an exterior of the housing;

a first sleeve slidably positioned within the housing and transitional from a first longitudinal position to a second longitudinal position upon the ACA experiencing a first pressure differential in which the pressure applied to the axial flowbore is greater than the pressure applied to the exterior of the housing by an amount exceeding a first threshold, a second sleeve slidably positioned within the housing below the first sleeve and transitional from a first longitudinal position to a second longitudinal position, wherein movement of the first sleeve from the first longitudinal position to the second longitudinal position of the first sleeve is effective to transition the second sleeve from the first longitudinal position to the second longitudinal position of the second sleeve; and the second sleeve being transitional from the second longitudinal position to a third longitudinal position;

a third sleeve slidably positioned within the housing below the second sleeve and transitional from a first longitudinal position to a second longitudinal position upon the ACA experiencing an application of pressure to the exterior of the housing of at least a second threshold pressure, wherein movement of the third sleeve from the first longitudinal position to the second longitudinal position is effective to transition the second sleeve from the second longitudinal position to the third longitudinal position of the second sleeve;

an atmospheric chamber located between the housing and the third sleeve; and a pressure port extending through the housing to fluidly connect a second annular chamber formed between the housing and the third sleeve to the exterior of the housing, wherein the atmospheric chamber and the second annular chamber are on opposite sides of a piston portion of the third sleeve.

2. The system of claim 1, wherein the ACA further comprises a first valve disposed within the housing to allow a route of fluid communication via the first flow port from the exterior of the housing to the axial flowbore and to not allow a route of fluid communication via the first flow port from the axial flowbore to the exterior of the housing.

3. The system of claim 2, wherein the valve comprises a deformable sleeve.

4. The system of claim 1, wherein the second sleeve further comprises a first sleeve port, wherein the first sleeve port is in fluid communication with the first flow port when the second sleeve is in the first longitudinal position.

5. The system of claim 4, wherein the second sleeve further comprises a second sleeve port, wherein the second sleeve port is in fluid communication with the second flow port when the second sleeve is in the second longitudinal position.

6. The system of claim 1, further comprising:

a packer disposed about the tubular string and up-hole relative to the ACA; and a plug incorporated with the tubular string and down-hole relative to the ACA.

7. The system of claim 1, further comprising a flow restrictor coupled with the second flow port.

8. The wellbore completion system of claim 1, wherein:

when the second sleeve is in the first longitudinal position, the ACA is configured to allow a route of fluid communication from the exterior of the housing to the axial flowbore via the first flow port and to not allow a route of fluid communication from the axial flowbore to the exterior of the housing via the first flow port;

when the second sleeve is in the second longitudinal position, the ACA is configured to provide a bidirectional flow of fluid communication between the exterior of the housing and the axial flowbore via the second flow port; and when the second sleeve is in the third longitudinal position, the ACA is configured to disallow any route of fluid communication between the exterior of the housing and the axial flowbore.

9. The wellbore completion system of claim 1, wherein the ACA further comprises a second valve disposed over the housing to allow a route of fluid communication via the second flow port from the axial flowbore to the exterior of the housing and to not allow a route of fluid communication via the second flow port from the exterior of the housing to the axial flowbore.

10. The wellbore completion system of claim 9, wherein the valve comprises a deformable sleeve.

11. The wellbore completion system of claim 1, wherein:

when the second sleeve is in the first longitudinal position, the ACA is configured to allow a route of fluid communication from the exterior of the housing to the axial flowbore via the first flow port and to not allow a route of fluid communication from the axial flowbore to the exterior of the housing via the first flow port;

when the second sleeve is in the second longitudinal position, the ACA is configured to allow a route of fluid communication from the axial flowbore to the exterior of the housing via the second flow port and to not allow a route of fluid communication from the exterior of the housing to the axial flowbore via the second flow port; and when the second sleeve is in the third longitudinal position, the ACA is configured to disallow any route of fluid communication between the exterior of the housing and the axial flowbore.

12. A wellbore completion method comprising:

positioning a tubular string comprising an autofill and circulation assembly (ACA) within a wellbore, wherein the ACA is positioned within the wellbore in a first configuration, wherein, when the ACA is in the first configuration, the ACA allows a route of fluid communication from an exterior of the ACA to an axial flowbore of the ACA and does not allow a route of fluid communication from the axial flowbore to the exterior of a housing of the ACA, wherein the ACA comprises a first sleeve, a second sleeve axially below the first sleeve, and a third sleeve axially below the second sleeve, wherein the first sleeve, second sleeve, and third sleeve are each slidable within the housing;

causing the ACA to experience a first pressure differential in which the pressure applied to the axial flowbore is greater than the pressure applied to the exterior of the housing by at least a first threshold pressure;

transitioning the ACA from the first configuration to a second configuration in response to the first pressure differential;

allowing a bidirectional flow of fluid communication between the exterior of the housing and the axial flowbore or a unidirectional flow of fluid communication from the exterior of the housing to the axial flowbore via a second flow port while the ACA is in the second configuration;

applying a second pressure to the exterior of the housing, this second pressure being above at least a second threshold pressure;

transitioning the ACA from the second configuration to a third configuration by applying the second pressure to a piston portion of the third sleeve via a pressure port extending through the housing to fluidly connect an annular chamber formed between the housing and the third sleeve to the exterior of the housing; and disallowing any route of fluid communication between the exterior of the ACA and the axial flowbore of the ACA when the ACA is in the third configuration.

13. A wellbore completion system, comprising:

a tubular string disposed within a wellbore;

an autofill and circulation assembly (ACA) incorporated within the tubular string and comprising:

a housing generally defining an axial flowbore and comprising a first flow port and a second flow port extending between the axial flowbore and an exterior of the housing;

a first sleeve slidably positioned within the housing and transitional from a first longitudinal position to a second longitudinal position upon a pressure of at least a first threshold pressure being applied to the axial flowbore;

a second sleeve slidably positioned within the housing below the first sleeve and transitional between a first longitudinal position and a second longitudinal position, wherein movement of the first sleeve from the first longitudinal position to the second longitudinal position of the first sleeve is effective to transition the second sleeve from the first longitudinal position to the second longitudinal position of the second sleeve; and the second sleeve being transitional from the second longitudinal position back to the first longitudinal position of the second sleeve in response to a fluid being communicated through the axial flowbore at a predetermined flow rate, wherein movement of the second sleeve from the second longitudinal position back to the first longitudinal position of the second sleeve is effective to transition the first sleeve from the second longitudinal position to a third longitudinal position of the first sleeve; and a pressure release port extending through the housing and fluidly connecting an annular space between the housing and the second sleeve to the exterior of the housing, wherein the pressure release port extends from a radially inner surface of the housing to a radially outer surface of the housing.

14. The system of claim 13, wherein the ACA further comprises a first valve disposed within the housing to allow a route of fluid communication via the first flow port from the exterior of the housing to the axial flowbore and to not allow a route of fluid communication via the first flow port from the axial flowbore to the exterior of the housing.

15. The system of claim 14, wherein the valve comprises a deformable sleeve.

16. The system of claim 13, wherein the first sleeve further comprises a first sleeve port, wherein the first sleeve port is in fluid communication with the first flow port when the first sleeve is in the first longitudinal position.

17. The system of claim 16, wherein the first sleeve further comprises a second sleeve port, wherein the second sleeve port is in fluid communication with the second flow port when the first sleeve is in the second longitudinal position.

18. The system of claim 13, wherein the ACA further comprises a second pressure release port extending through the first sleeve to fluidly connect an atmospheric chamber formed between the housing and the first sleeve to the axial flowbore.

19. The system of claim 13, wherein:

when the first sleeve is in the first longitudinal position, the ACA is configured to allow a route of fluid communication from the exterior of the housing to the axial flowbore via the first flow port and to not allow a route of fluid communication from the axial flowbore to the exterior of the housing via the first flow port;

when the first sleeve is in the second longitudinal position, the ACA is configured to provide a bidirectional flow of fluid communication between the exterior of the housing and the axial flowbore via the second flow port; and when the first sleeve is in the third longitudinal position, the ACA is configured to disallow any route of fluid communication between the exterior of the housing and the axial flowbore.

* * * * *